US007719560B2

(12) United States Patent
Koizumi et al.

(10) Patent No.: US 7,719,560 B2
(45) Date of Patent: May 18, 2010

(54) LINE HEAD AND IMAGING APPARATUS INCORPORATING THE SAME

(75) Inventors: Ryuta Koizumi, Suwa (JP); Takeshi Sowa, Suwa (JP); Yujiro Nomura, Suwa (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 30 days.

(21) Appl. No.: 11/923,412

(22) Filed: Oct. 24, 2007

(65) Prior Publication Data

US 2008/0106590 A1 May 8, 2008

(30) Foreign Application Priority Data

Oct. 26, 2006 (JP) ..... 2006-291124
Jul. 11, 2007 (JP) ..... 2007-182235

(51) Int. Cl.
*B41J 2/45* (2006.01)

(52) U.S. Cl. ..... 347/238

(58) Field of Classification Search ..... 347/238, 347/241, 230, 244, 256, 258
See application file for complete search history.

(56) References Cited

U.S. PATENT DOCUMENTS 5,539,444 A * 7/1996 Ikeda et al. ..... 347/241
6,538,682 B2 * 3/2003 Ohkubo ..... 347/241
6,825,867 B2 * 11/2004 Koga et al. ..... 347/238
7,432,947 B2 * 10/2008 Yosuke ..... 347/244

FOREIGN PATENT DOCUMENTS

JP 02-004546 1/1990
JP 06-278314 10/1994
JP 10129035 A * 5/1998
JP 11048526 A * 2/1999

* cited by examiner

*Primary Examiner*—Hai C Pham
(74) *Attorney, Agent, or Firm*—Hogan & Hartson LLP

(57) ABSTRACT

An optical write line head includes multiple rows of light emitter devices lined up corresponding to respective positive lenses located in array form, wherein even with a fluctuation of its write plane in an optical axis direction, there is none of variations resulting from displacements of light emitting dots. A plurality of light emitter blocks, each including at least one row of light emitter devices lined up in a main scan direction, are located at a spacing in the main scan direction to define a light emitter array. On the exit side of the light emitter array, a lens array including one positive lens system in alignment with each light emitter block is located parallel with the light emitter array, and a write plane is located parallel on the imaging side of the lens array. A stop plate forming an aperture stop is located near a light-gathering position at which parallel light incident from the write plane side on each positive lens system comes together.

10 Claims, 35 Drawing Sheets

LINE HEAD AND IMAGING APPARATUS INCORPORATING THE SAME

CROSS-REFERENCE TO RELATED APPLICATIONS

This application claims the benefit of priority under 35 USC 119 to Japanese Patent Application No. 2006-291124, filed on Oct. 26, 2006, and Japanese Patent Application No. 2007-182235, filed on Jul. 11, 2007, the entire contents of which are incorporated by reference.

BACKGROUND OF THE INVENTION

The present invention relates generally to a line head and an imaging apparatus incorporating the same, and more particularly to a line head wherein a micro lens array is used to project a row of light emitter devices onto an application plane to form a row of imaging spots and an imaging apparatus using the same.

So far, Patent Publication 1 has come up with an optical write line head wherein multiple LED array chips are located in an LED array direction, and the LED array of each LED array chip is projected and magnified through a correspondingly located positive lens onto a photosensitive member, so that images of light emitting dots at the ends of the LED array chips adjacent to one another on the photosensitive member are formed adjacently at the same pitch as the inter-image pitch of the light emitting dots of the same LED array chip, and an optical read line head with the optical path reversed.

Further, Patent Publication 2 has proposed an optical write line head wherein two rows of LED array chips are arranged at a spacing, and two rows of positive lens arrays, each having a positive lens corresponding to each LED array chip, are arranged at a repetitive phase that is a half period off, so that images of light emitting dot arrays are lined up on a photosensitive member.

Patent Publication 1

JP(A)2-4546

Patent Publication 2

JP(A)6-278314

In such prior arts, if the image plane budges forth and back in the optical axis direction of the lens due to vibrations, etc. of the photosensitive member, there is then a displacement of the light emitting dots on the photosensitive member, which otherwise gives rise to a variation in the pitch between scan lines drawn by the relative movement of the light emitting dot array in the subordinate scan direction (a pitch variation in the main scan direction. The same can be said of even when images of the light emitting dot array are in alignment with one another on an ideal image plane.

In view of such problems with the prior art as described above, one object of the present invention is to provide an optical write line head comprising a row of light emitter devices lined up corresponding to each of multiple positive lenses arranged in array form, wherein even with the write plane fluctuating in the optical axis direction, there is none of variations resulting from displacements of light emitting dots.

Another object of the invention is to provide an imaging apparatus incorporating such an optical write line head, and an optical read line head with the optical path reversed.

SUMMARY OF THE INVENTION

According to the present invention, each of the aforesaid objects is accomplishable by the provision of a line head, characterized in that a plurality of light emitter blocks, each comprising at least one row of multiple light emitter devices located in a main scan direction, are located at a spacing at least in the main scan direction to define a light emitter array, a lens array having a positive lens system located on an exit side of said light emitter array corresponding to said light emitter block is located in opposition to said light emitter array, a write plane is located on an imaging side of said lens array, and a stop plate having an aperture stop is located near a light-gathering position at which parallel light incident from said write plane side on said lens array comes together.

It is thus possible to prevent variations from occurring by reason of displacements of light emitting dots even when fluctuations of the write plane in the optical axis direction, thereby preventing deterioration of the resulting image.

In a preferable embodiment of the invention, said aperture stop is located off said light-gathering position by ±10% of the focal length of a lens system portion of said positive lens system on the imaging side of said positive lens system with respect to said aperture stop.

It is thus possible to prevent variations from occurring by reason of displacements of light emitting dots even when fluctuations of the write plane in the optical axis direction, thereby preventing deterioration of the resulting image.

In an embodiment of the invention, said positive lens system may comprise a single positive lens.

It is thus possible to simplify the setup of the line head.

In an embodiment of the invention, said positive lens system may comprise two positive lenses.

It is thus possible not only to facilitate the fabrication of individual lens arrays, but also to facilitate correction of aberrations.

In that case, said stop plate may be located near the front focal position of the positive lens on the image side.

It is thus possible to locate the stop plate in the lens array in an integral fashion.

In these embodiments of the invention, said light emitter array may have said row of light emitter devices on a first surface of a transparent substrate, said lens array may be located on a second surface side opposite to said first surface of said transparent substrate, and said stop plate may be brought in contact with, and located over, said second surface of said transparent substrate.

It is thus possible to adapt well to the bottom emission type organic EL devices. It is further possible to facilitate the alignment, retaining, etc. of the stop plate. It is further possible to make the stop plate integral with the front surface of the transparent substrate by means of vapor deposition, printing or the like.

In a preferable embodiment of the invention, said aperture stop is configured into a shape enough to limit an aperture diameter at least in the main scan direction.

It is thus possible to cope with the main scan direction in which at least displacements of off-axis imaging spots become a problem.

In a preferable embodiment of the invention, said light emitter block includes a plurality of rows of light emitter devices located in a subordinate scan direction.

It is thus possible to form an image at an increased imaging spot density.

In a preferable embodiment of the invention, there are multiple such light emitter blocks located in the subordinate scan direction.

It is thus possible to form an image at an increased imaging spot density.

In a preferable embodiment of the invention, each of said light emitter devices is an organic EL device.

It is thus possible to form an image that is uniform in plane.

In a preferable embodiment of the invention, each of said light emitter devices is an LED.

It is thus possible to adapt well to a line head using an LED array, too.

The present invention also provides an imaging apparatus, characterized by comprising at least two imaging stations, each having an imaging unit comprising an image carrier, an electrifying means, such a line head as mentioned above, a developing means and a transfer means, wherein an image is formed in a tandem mode.

It is thus possible to set up an imaging apparatus such as a printer that can form less deteriorative images in small format yet with high resolving power.

Further, the present invention includes a line head, characterized in that a plurality of light emitter blocks, each comprising at least one row of multiple light emitter devices located in a main scan direction, are located at a spacing at least in the main scan direction to define a light emitter array, a lens array having a positive lens system located on an exit side of said light emitter array corresponding to said light emitter block is located in opposition to said light emitter array, a write plane is located on an imaging side of said lens array, and a stop plate having an aperture stop is located near a light-gathering position at which parallel light incident from said write plane side on said lens array comes together.

Thus, it is also possible to apply the invention to an optical read line head wherein even with the read plane displacing in the optical axis direction, the read spots can be kept from displacement, thereby preventing deterioration of the images read.

Still other objects and advantages of the invention will in part be obvious and will in part be apparent for the specification.

The invention accordingly comprises the features of construction, combinations of devices, and arrangement of parts which will be exemplified in the construction hereinafter set forth, and the scope of the invention will be indicated in the claims.

DESCRIPTION OF THE PREFERRED EMBODIMENTS

Before expounding the optical system for the line head according to the invention, a brief account is given of the location of light emitter devices and light emitting timing.

Figure 4:
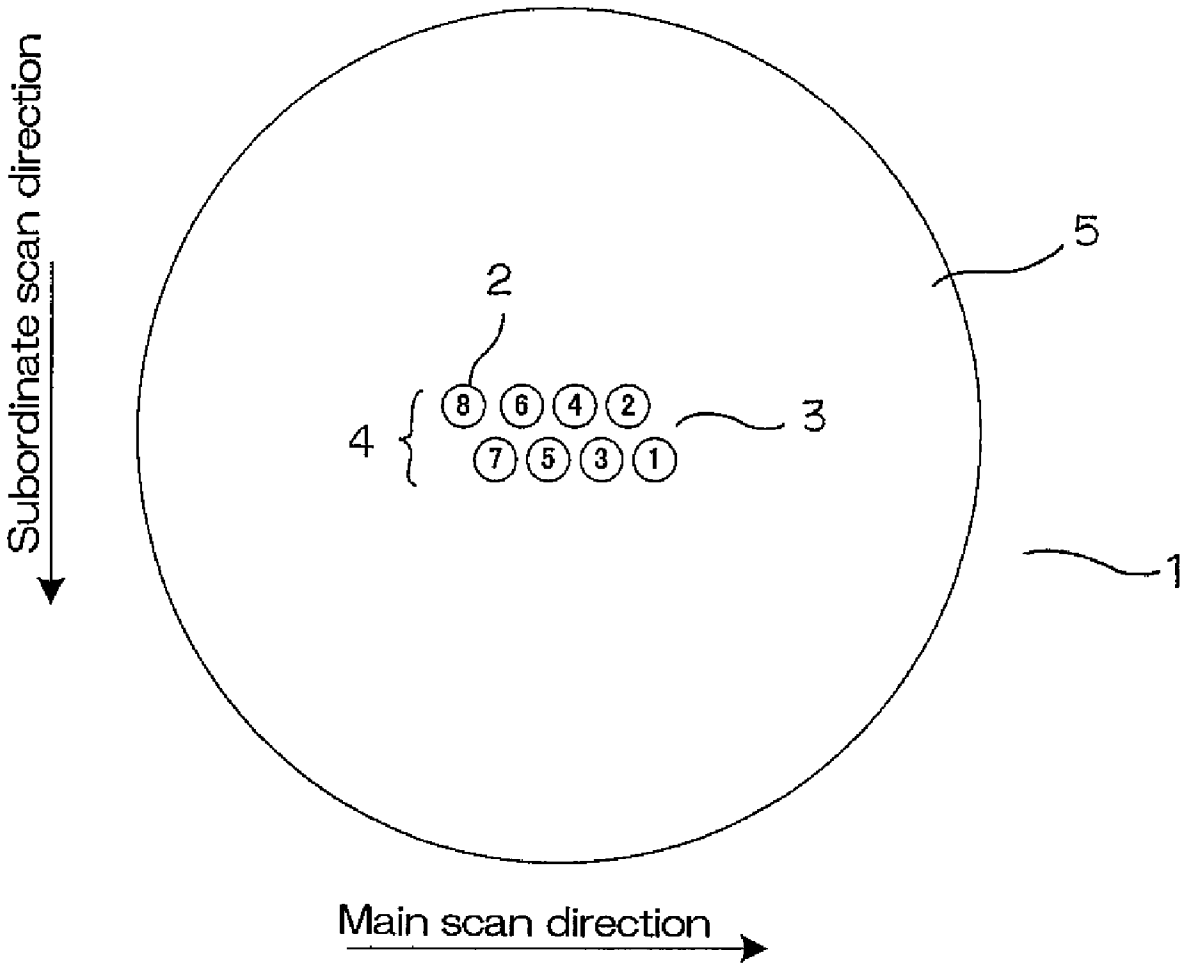
FIG. 4 is illustrative of what relation a light emitter array has to a micro lens having a minus optical magnification in one embodiment of the invention.

FIG. 4 is illustrative of what relation a light emitter array 1 has to a microlens 5 having a minus optical magnification in one embodiment of the invention. In the line head here, one microlens 5 corresponds to two rows of light emitter devices. It is noted, however, that the microlens 5 is an imaging device having a minus optical magnification (inverted imaging); the positions of the light emitter devices are flipped over between the main and the subordinate scan direction. Referring specifically to the setup of FIG. 1, even-numbered light emitter devices (8, 6, 4, 2) are lined up upstream of the direction of movement of an image carrier (in the first row) while odd-numbered light emitter devices (7, 5, 3, 1) are lined up downstream of it (in the second row), and in order from the front end of the main scan direction, the light emitter devices grow small in number.

Figure 1:
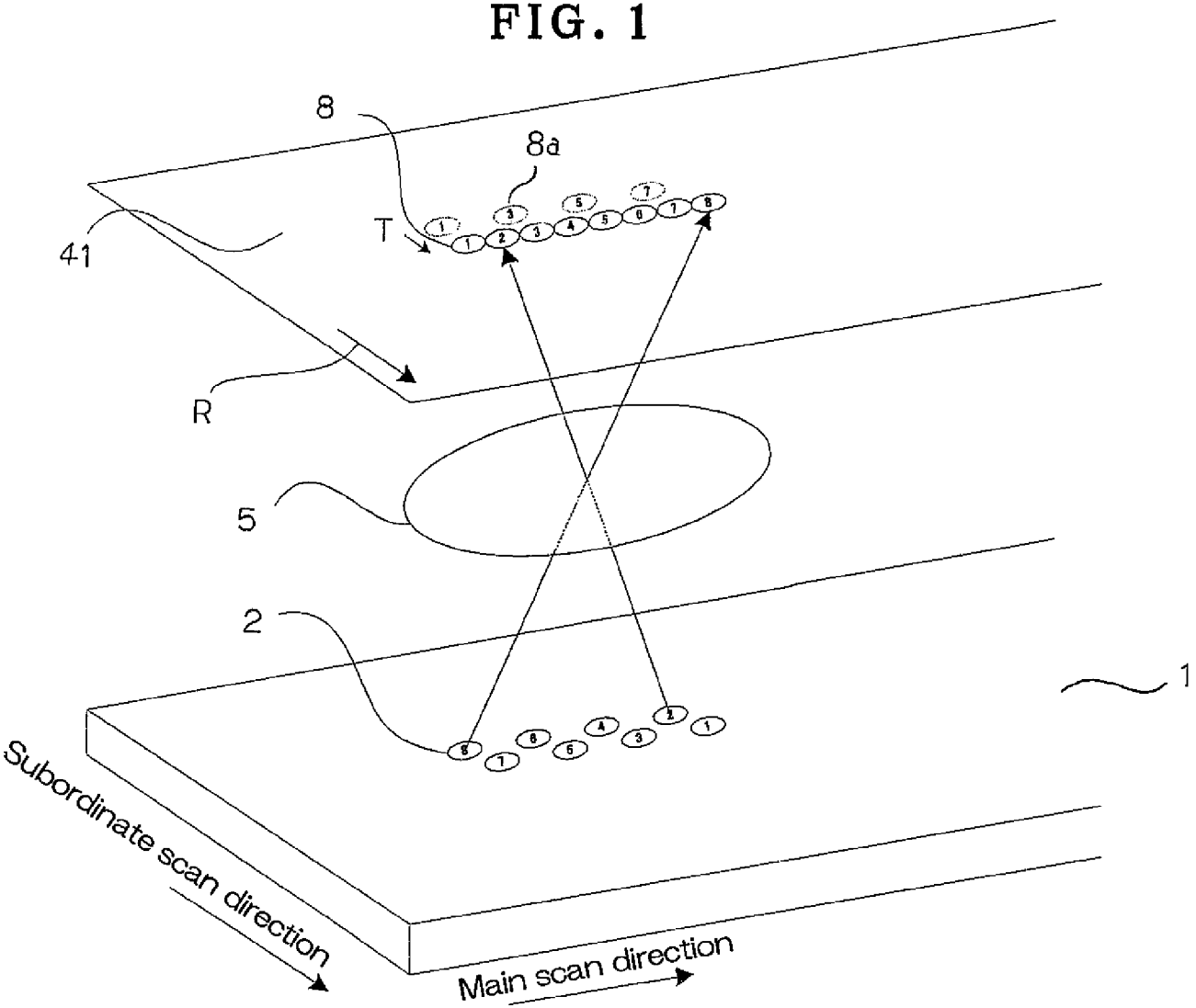
FIG. 1 is illustrative in perspective of a portion of the line head according to one embodiment of the invention, which corresponds to one micro lens.
Figure 2:
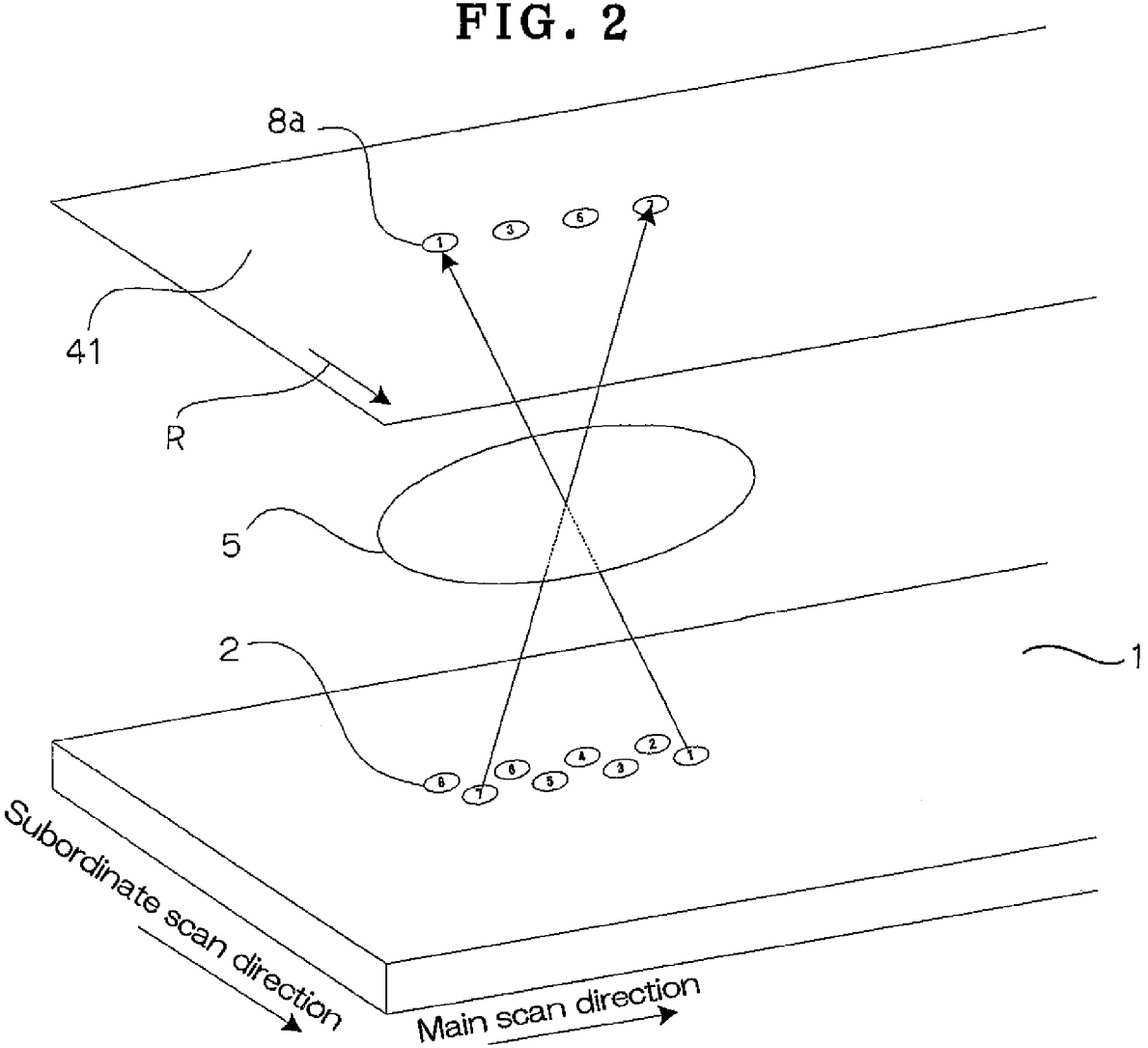
FIG. 2 is illustrative in perspective of a portion of the line head according to one embodiment of the invention, which corresponds to one micro lens.
Figure 3:
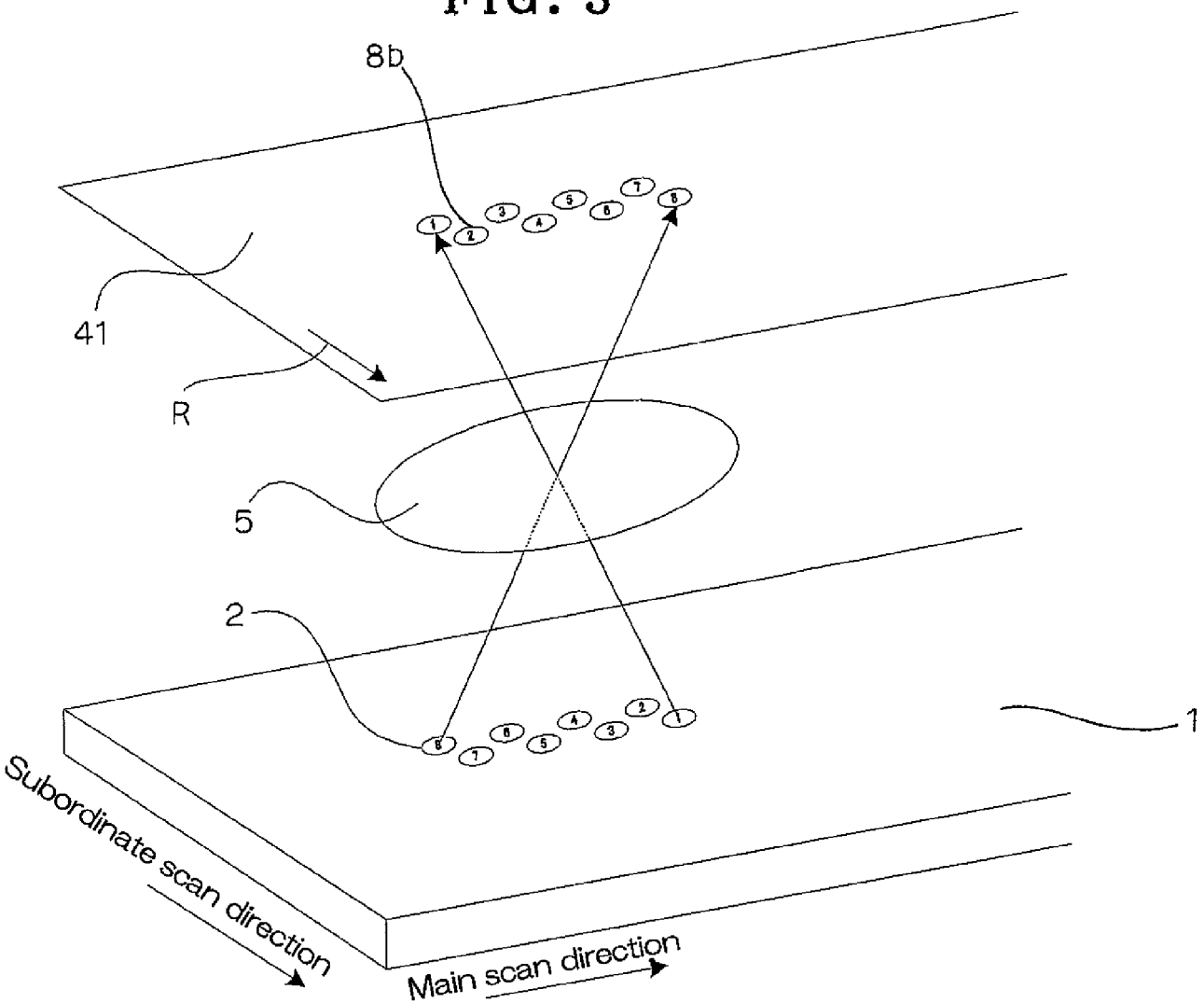
FIG. 3 is illustrative in perspective of a portion of the line head according to one embodiment of the invention, which corresponds to one micro lens.

FIGS. 1, 2 and 3 are each illustrative in perspective of the portion of the line head here corresponding to one micro-lens. As shown in FIG. 2, an imaging spot 8*a* on the image carrier 41 corresponding to an odd-numbered light emitter device 2 lying downstream of the image carrier 41 is formed at a position flipped over in the main scan direction. R stands for the direction of movement of the image carrier 41. As shown in FIG. 3, an imaging spot 8*b* on the image carrier 41 corresponding to an even-numbered light emitter 2 lying upstream (the first row) of the image carrier 41 is formed at a downstream position flipped over in the subordinate scan direction. In the main scan direction, however, the positions of imaging spots from the front end correspond to light emitter device Nos. 1 to 8 in order. It is then appreciated that by regulation of the timing of forming imaging spots in the subordinate scan direction of the image carrier, it is possible to form imaging spots in alignment in the main scan direction.

Figure 5:
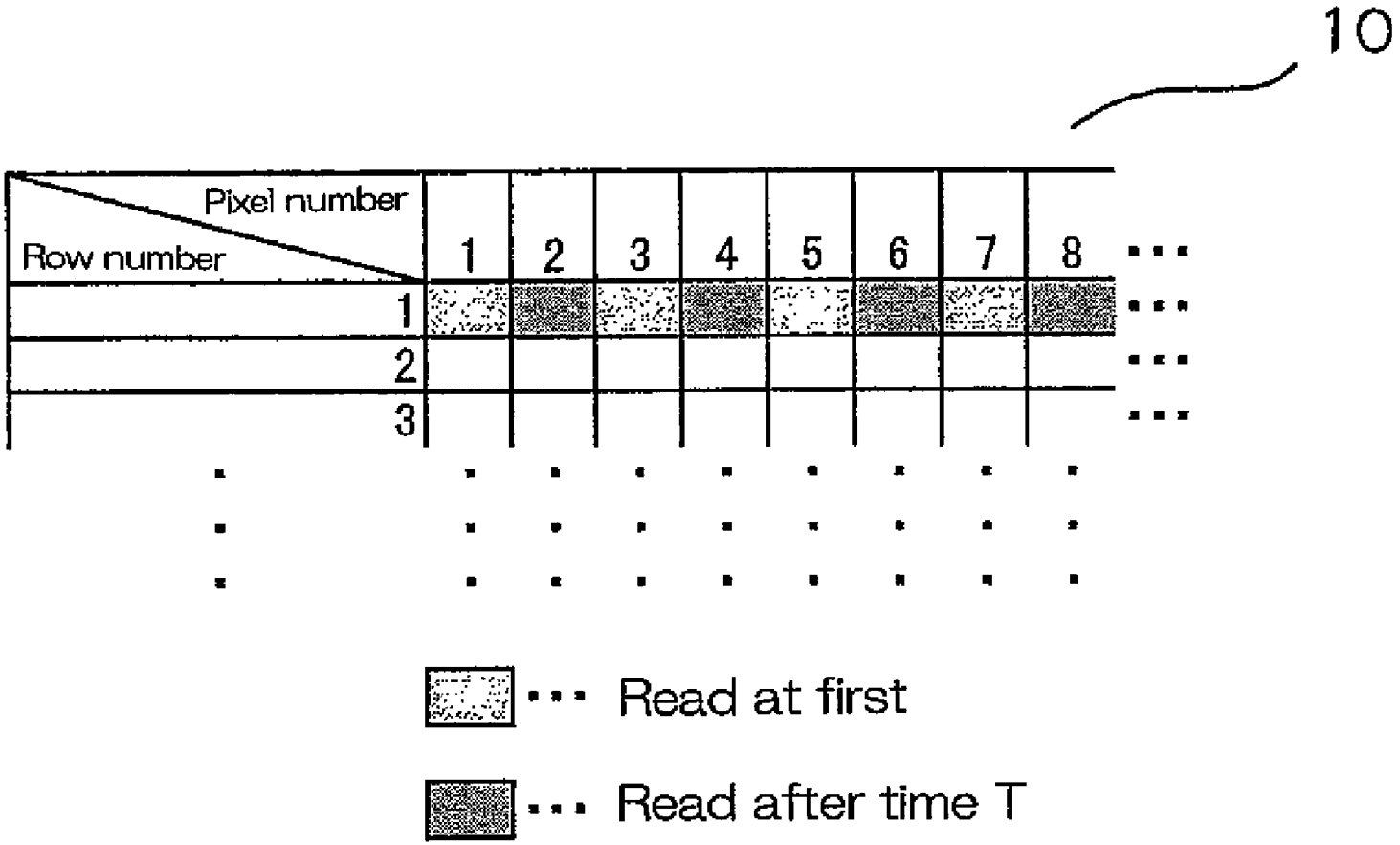
FIG. 5 is illustrative of an example of the line buffer memory table with image data loaded in it.

FIG. 5 is illustrative of one exemplary line buffer memory table 10 with image data loaded in it. In the memory table 10 of FIG. 5, the image data are loaded while flipped over in the main scan direction with respect to the numbers of the light emitter devices of FIG. 4. In FIG. 5, out of the image data loaded in the line buffer memory table 10, the first image data (1, 3, 5, 7) corresponding to the light emitter devices upstream of the image carrier 41 (the first row) are read to allow them to emit light. Then, after time T, the second image data (2, 4, 6, 8) loaded in a memory address and corresponding to the light emitter devices downstream of the image carrier 41 (the second row) are read out to allow them to emit light. Thus, the imaging spots in the first row on the image carrier are formed in alignment with the imaging spots in the second row in the main scan direction.

Figure 6:
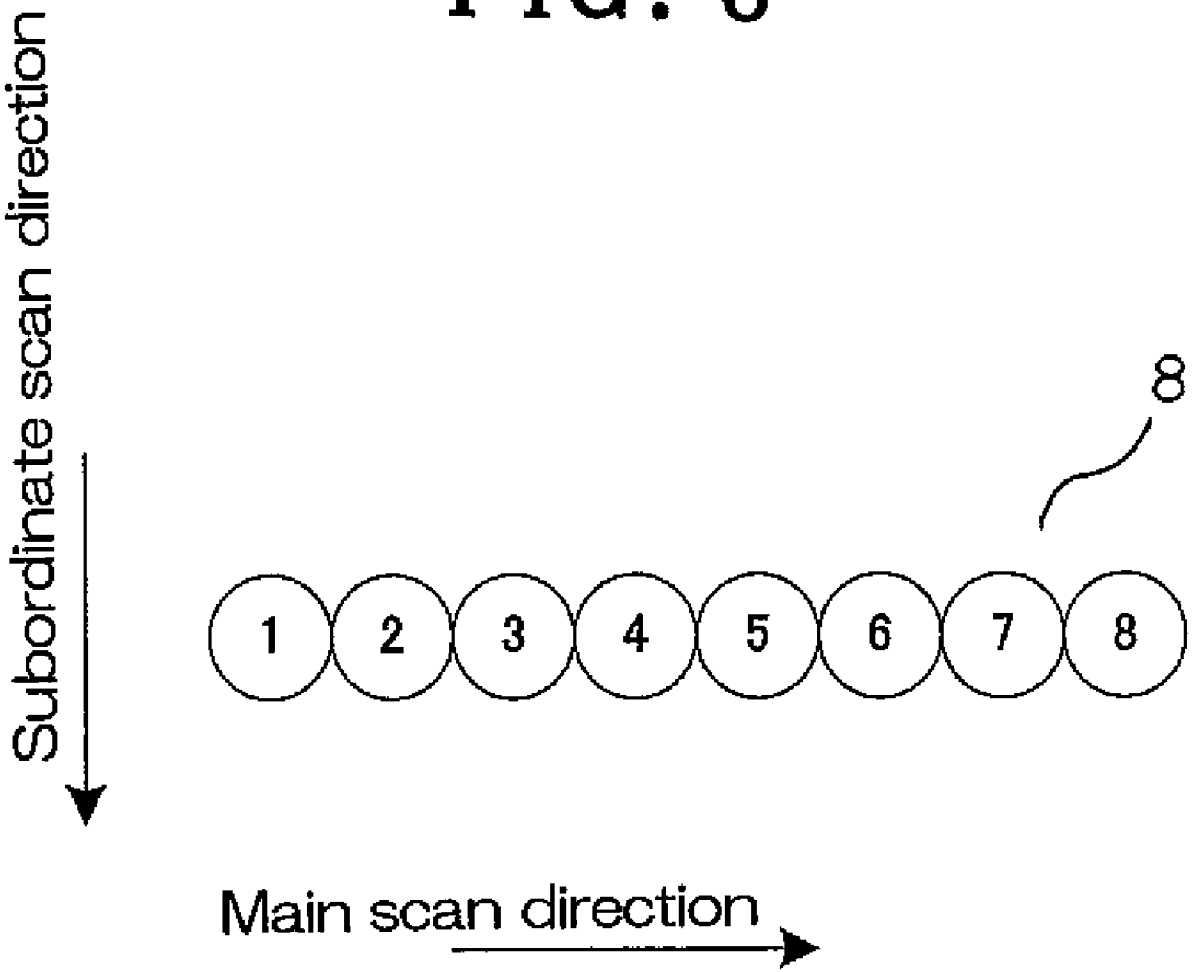
FIG. 6 is illustrative of in what state image-formation spots are formed in the same row by light emitter devices having an odd number and an even number in a main scan direction.

FIG. 1 is illustrative in perspective and conception of an example of reading the image data at the timing of FIG. 5 to form imaging spots. As already described with reference to FIG. 5, the light emitter devices upstream of the image carrier 41 (the first row) are first allowed to emit light to form the imaging spots on the image carrier 41. Then, after the elapse of a given timing T, the odd-numbered light emitter devices downstream of the image carrier (the second row) are allowed to give out light to form the imaging spots on the image carrier. In this case, the imaging spots defined by the odd-numbered light emitter devices are formed, not at the position 8*a* explained with reference to FIG. 2, at a position 8 and in alignment with the main scan line, as shown in FIG. 6.

Figure 7:
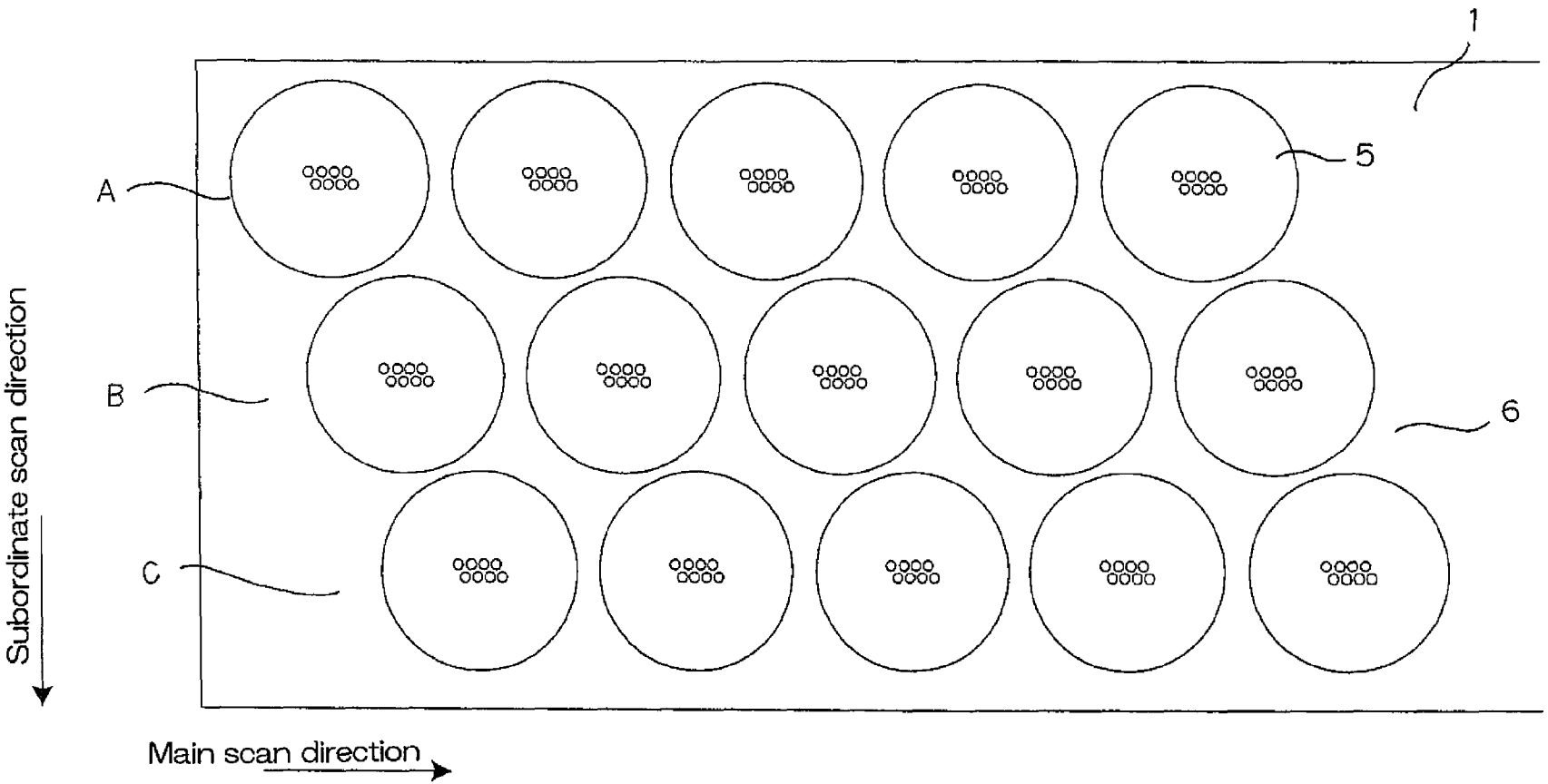
FIG. 7 is illustrative in schematic of an example of the light emitter array used as a line head.

FIG. 7 is illustrative in schematic of one exemplary light emitter array used as the line head. In FIG. 7, a light emitter array 1 is provided with a light emitter block (see FIG. 4) wherein multiple light emitter rows 3, each having multiple light emitter devices 2 lined up in the main scan direction, are provided in the subordinate scan direction. In the example of FIG. 7, the light emitter block 4 is made up of two light emitter device rows 3 in the subordinate scan direction, each having four light emitter devices 2 lined up in the main scan direction (see FIG. 4). A multiplicity of such light emitter blocks 4 are arranged on the light emitter array 1, each corresponding to the microlens 5.

Multiple such microlenses 5 are provided in the main and the subordinate scan direction of the light emitter array 1 to form a microlens array (MLA) 6. In this MLA 6, the front end of the main scan direction is offset from that of the subordinate scan direction. The setup of such MLA 6 corresponds to a zigzag layout of light emitter devices arranged on the light emitter array 1. In the example of FIG. 7, three such MLAs 6 are arranged in the subordinate scan direction. In what follows, the unit blocks 4 corresponding to the positions of three rows of MLAs 6 in the subordinate scan direction will hereinafter be referred to as Groups A, B and C, respectively, for the sake of description.

When, as described above, multiple light emitter devices 2 are located within the microlens 5 having a minus optical magnification and multiple such lenses are located in the subordinate scan direction, the formation of imaging spots lined up in a row in the main scan direction of the image carrier 41 requires the following image data controls: (1) the flipping of the subordinate scan direction, (2) the flipping of the main scan direction, (3) the regulation of light emission timing for multiple rows of light emitter devices, and (4) the regulation of light emission timing for light emitting devices between the Groups.

Figure 8:
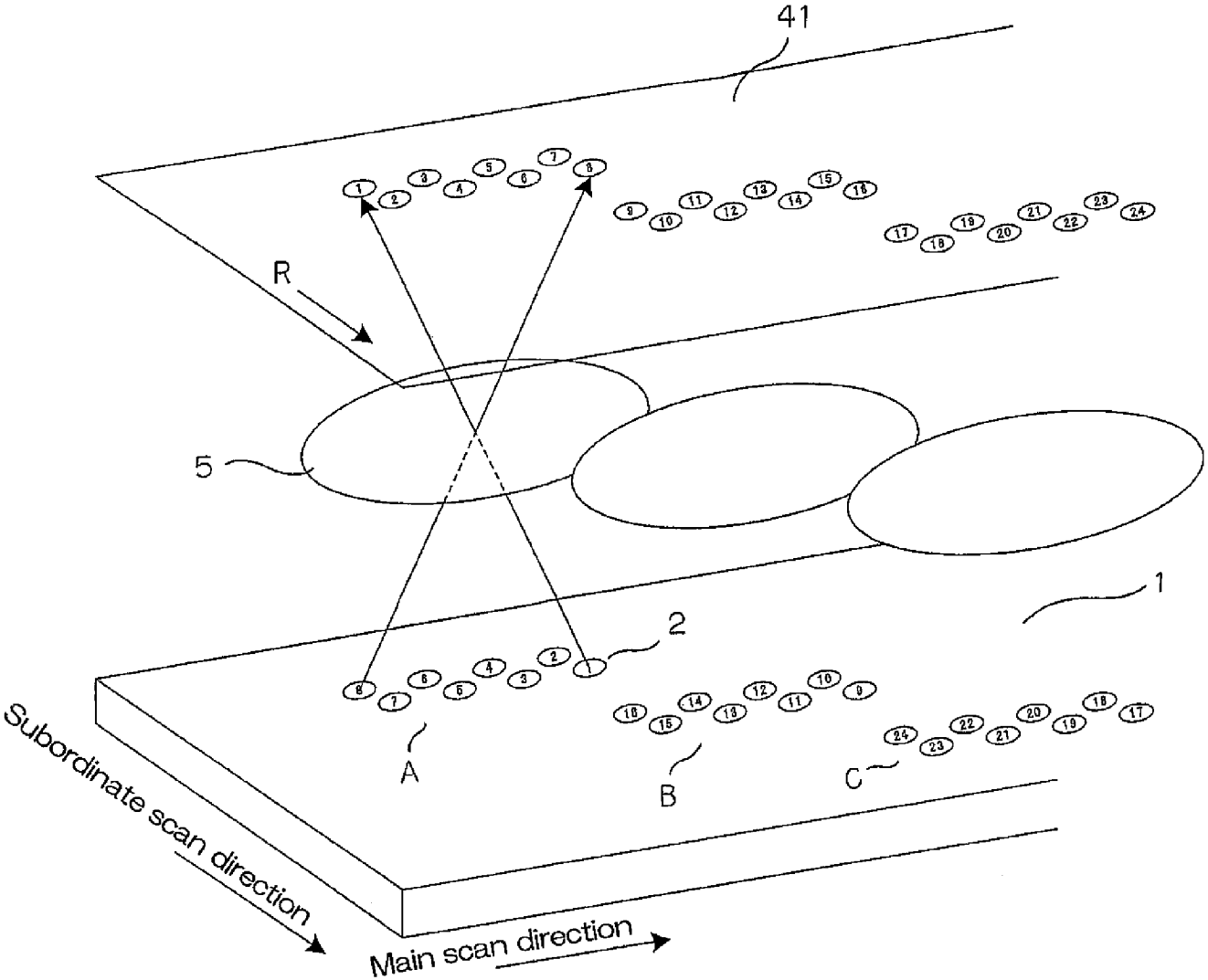
FIG. 8 is illustrative of the imaging position in the case wherein light produced out of each light emitter device is directed to the exposure surface of the image carrier through the micro lens.

FIG. 8 is illustrative of an imaging position in the case where light produced out of each light emitter device 2 is directed to the exposure surface of the image carrier through the microlens 5. In FIG. 8, the light emitter array 1 comprises unit blocks 4, each having Groups A, B and C, as explained with reference to FIG. 7. The light emitter device row in the unit block 4 divided into Groups A, B and C is broken down into upstream (the first row) and downstream (the second row) of the image carrier 41, the even-numbered light emitter devices assigned to the first row and the odd-numbered light emitter devices assigned to the second row.

Referring to Group A, each light emitter device 2 is operated as explained with reference to FIGS. 1, 2 and 3, whereby imaging spots are formed at the flipped positions in the main, and the subordinate direction. In this way, there are the imaging spots formed on the image carrier 41 in the same row in the main scan direction in the order of 1 to 8. Likewise, the processing for Group B is implemented while the image carrier 41 is moved for a given time in the subordinate scan direction. Further, the processing for Group C is implemented while the image carrier 41 is moved for a given time in the subordinate scan direction, whereby imaging spots on the basis of the entered image data are formed in the same row in the main scan direction in the order of 1 to 24 . . . .

Figure 9:
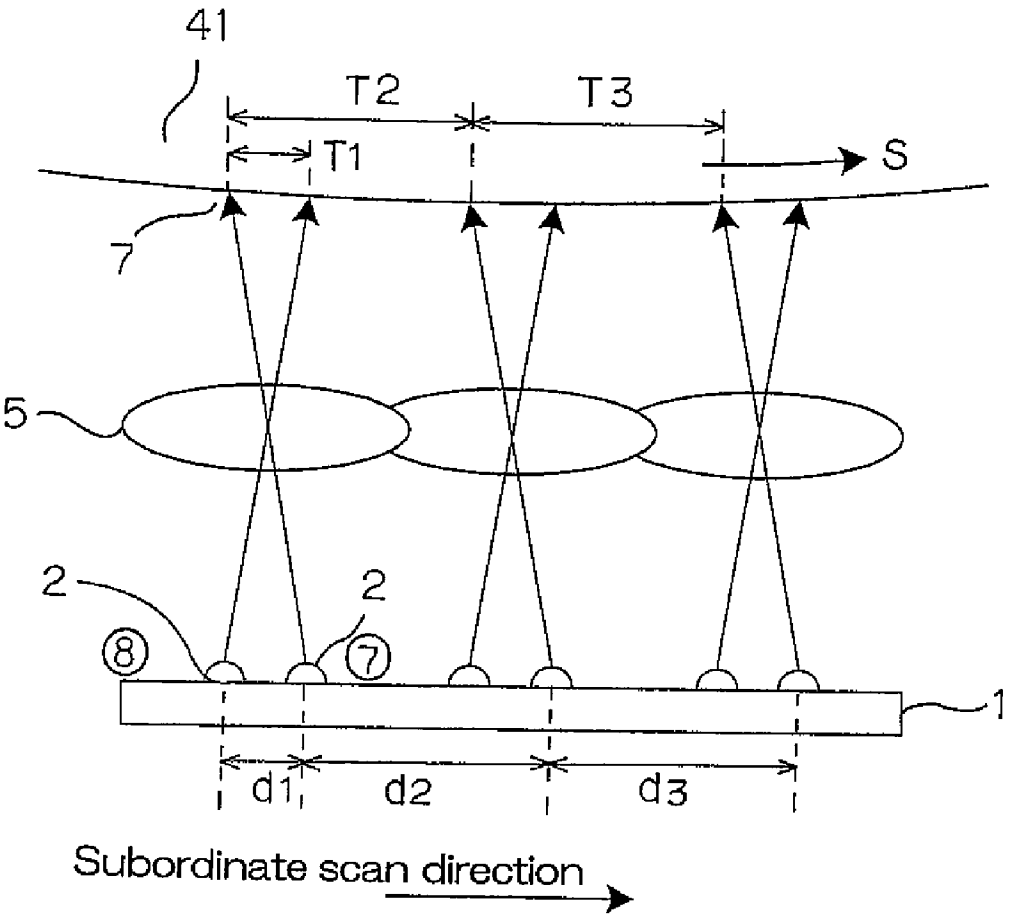
FIG. 9 is illustrative of in what state there is the imaging spot formed in the subordinate scan direction in FIG. 8.

FIG. 9 is illustrative of in what state the imaging spots are formed in the subordinate scan direction in FIG. 8. S is the moving speed of the image carrier 41, d1 is the spacing between the light emitter devices in the first and second rows in Group A, d2 is the spacing between the light emitter devices in the second row in Group 1 and the light emitter devices in the second row in Group B, d3 is the spacing between the light emitter devices in the second row in Group B and the light emitter devices in the second row in Group C, T1 is the time from after the light emitter devices in the second row in Group A emit light until the light emitter devices in the first row in Group A emit light, T2 is the time during which the imaging position by the light emitter devices in the second row in Group A moves to the imaging position for the light emitter devices in the second row in Group B, and T3 is the time during which the imaging position by the light emitter devices in the second row in Group A moves to the imaging position for the light emitter devices in the second row in Group C.

T1 may be found out as follows. T2, and T3 may just as well be found if d1 is replaced by d2, and d3.

$$T1=|(d1\times\beta)/S|$$

Here the parameters d1, S and b are d1: the distance of the light emitter device in the subordinate scan direction, S: the moving speed of the imaging plane (image carrier), and β: the magnification of the lens.

Figure 10:
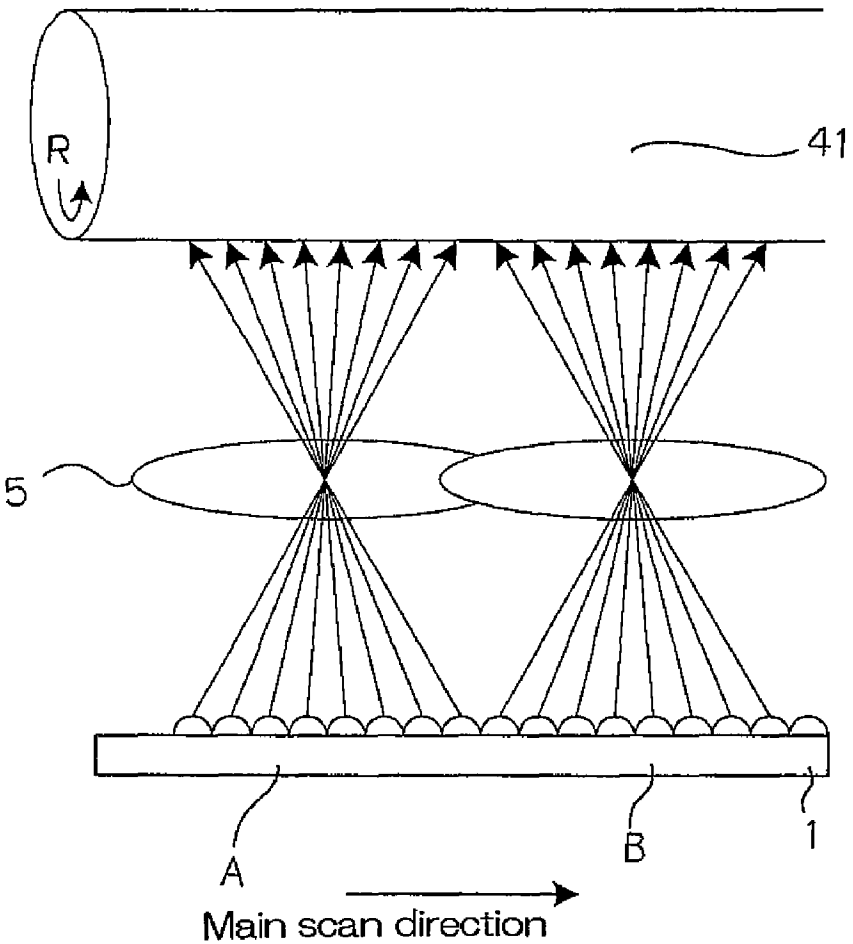
FIG. 10 is illustrative of an example wherein the imaging spot is flipped over and formed in the main scan direction of the image carrier in the case where micro-lenses are aligned in multiple rows.

In FIG. 9, after the time T2 when the light emitter devices in the second row in Group A emit light, the light emitter devices in the second row in Group B emit light. Further, at T3 after T2, the light emitter devices in the second row in Group C emit light. The light emitter devices in the first row in each group emit light at time T1 after the light emitter devices in the second row emit light. By implementing such processing, the imaging spots by the light emitters two-dimensionally aligned on the light emitter array 2 can be formed in a row on the image carrier, as shown in FIG. 8. FIG. 10 is illustrative of an example wherein the imaging spots are flipped over and formed in the main scan direction of the image carrier in the case where the microlenses are aligned in multiple rows.

Figure 11:
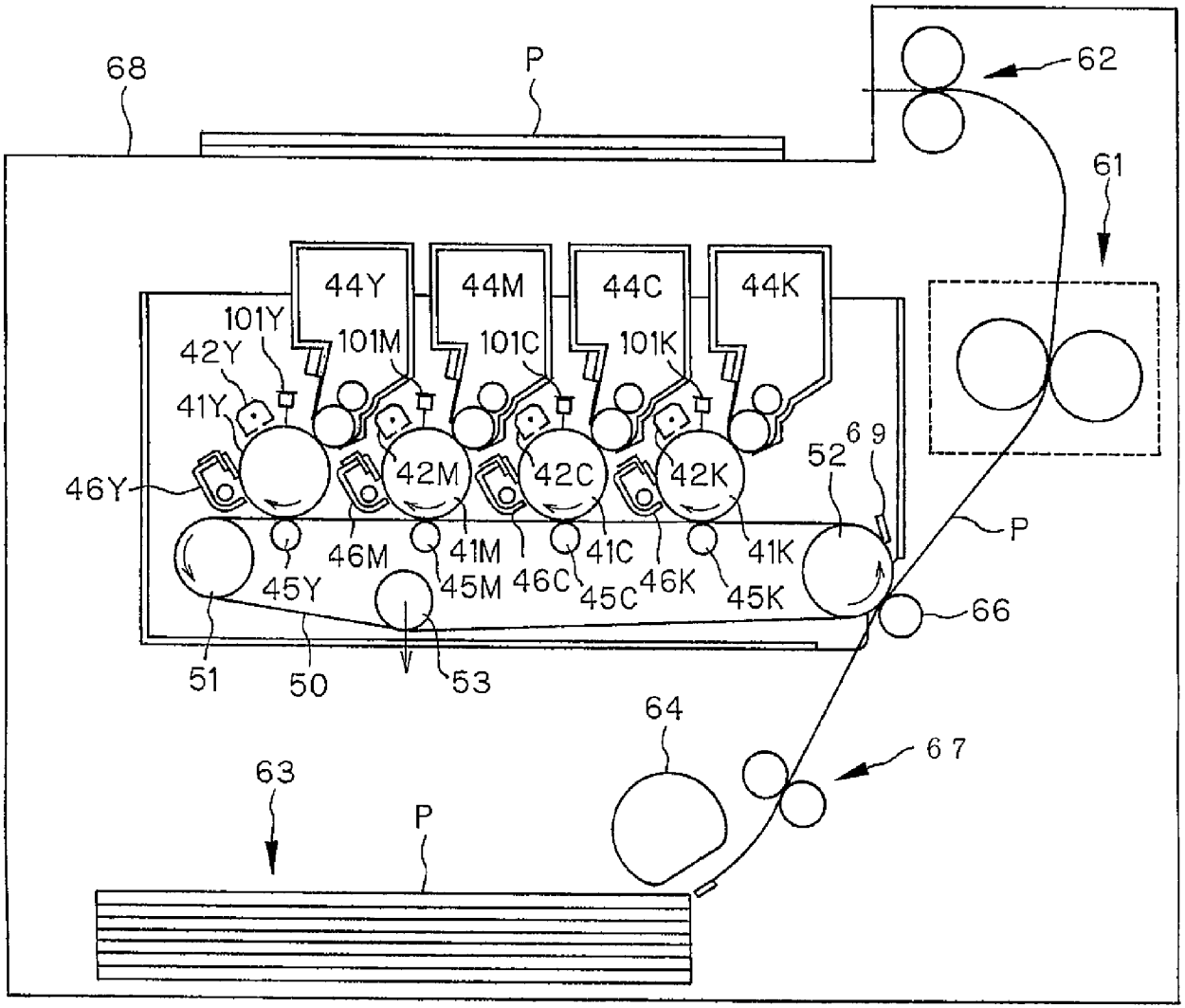
FIG. 11 is illustrative in section and schematic of one example of the inventive imaging apparatus using an electronic photographic process.

An imaging apparatus may be set up using such a line head as mentioned above. In one embodiment of the invention, that line head may be used with a tandem type color printer (imaging apparatus) wherein four photo-sensitive materials are exposed to light with four line heads to simultaneously form images in four colors, and those images are transferred onto one endless intermediate transfer belt (intermediate transfer medium). FIG. 11 is a longitudinal section illustrative of one example of the tandem type imaging apparatus with organic EL devices used as light emitter devices. In this tandem type imaging apparatus, four line heads 101K, 101C, 101M and 101Y of similar construction are located at the exposure positions of four photosensitive material drums (image carriers) 41K, 41C, 41M and 41Y that are correspondingly of similar construction.

As shown in FIG. 11, this imaging apparatus comprises a drive roller 51, a follower roller 52 and a tension roller 53, and further includes an intermediate transfer belt (intermediate transfer medium) 50 that is tensioned by the tension roller 53 and endlessly driven in a direction indicated by an arrow (counterclockwise direction). The photosensitive members 41K, 41C, 41M and 41Y, each having a photosensitive layer on its outer periphery, are positioned as four image carriers located at a given interval with respect to the intermediate transfer belt 50.

The capitals K, C, M and Y affixed to the numerals 101 and 41 mean black, cyan, magenta and yellow, respectively; they are indicative of the photosensitive members for black, cyan, magenta and yellow, respectively. The same will hold for other members. In synchronization with the operation of the intermediate transfer belt 50, the photosensitive members 41K, 41C, 41M and 41Y are rotationally driven in the direction indicated by an arrow (clockwise direction). Located around each photosensitive member 41(K, C, M, Y) are a charger means (corona charger) 42(K, C, M, Y) adapted to uniformly electrify the outer circumference of each photosensitive member 41(K, C, M, Y) and the line head 101(K, C, M, Y) such as the one described above adapted to sequentially line scan the outer circumference uniformly electrified by that charger means 42(K, C, M, Y) in synchronization with the rotation of the photosensitive member 41(K, C, M, Y).

The imaging apparatus here further comprises a developing device 44(K, C, M, Y) adapted to apply a developer or toner to an electrostatic image formed at the line head 101(K, C, M, Y) to convert it into a visible image (toner image), a primary transfer roller 45 (K, C, M, Y) acting as a transfer means adapted to transfer the toner image developed by the developing device 44 onto the intermediate transfer belt 50 that is the primary transfer application member, and a cleaning device 46(K, C, M, Y) acting as a cleaning means adapted to remove the remnant of the toner remaining on the surface of the photosensitive member 41(K, C, M, Y) after transfer.

Here, each line head 101(K, C, M, Y) is located such that the array direction of the line head 101 (K, C, M, Y) lies along the bus of the photosensitive drum 41 (K, C, M, Y). And the emission energy peak wavelength of each line head 101(K, C, M, Y) is set in such a way as to substantially match with the sensitivity peak wavelength of the photosensitive member 41(K, C, M, Y).

The developing device 44(K, C, M, Y) uses as the developer a nonmagnetic one-component toner, for instance. That one-component developer is then delivered by, e.g., a feeding roller to a developing roller. While the thickness of a developer film deposited onto the surface of the developing roller is regulated by a regulating blade, that developing roller is brought in contact or engagement with the photosensitive member 41(K, C, M, Y), whereby the developer is deposited onto the photosensitive member 41(K, C, M, Y) depending on its potential level to develop the electrostatic image as the toner image.

The respective black, cyan, magenta and yellow toner images formed at such a four-color, monochromatic toner image-formation station are sequentially primary transferred onto the intermediate transfer belt 50 by primary transfer bias applied to the primary transfer roller 45(K, C, M, Y), on which they are sequentially put one upon another into a full-color toner image. Then, that full-color toner image is secondary transferred at a secondary transfer roller 66 onto a recording medium P such as paper, and fixed onto the recording medium P through a pair of fixing rollers 61 that are a fixer. Finally, the recording medium P is delivered off through a pair of delivery rollers 62 onto a taking-off tray 68 mounted on the upper portion of the apparatus.

In FIG. 11, reference numeral 63 stands for a feeder cassette containing a number of recording media P piled up, 64 a pickup roller operable to feed the recording media P one by one from the feeder cassette 63, 65 a pair of gate rollers operable to set the timing of feeding the recording medium P to the secondary transfer portion of the secondary transfer roller 66, 66 the secondary transfer roller operable as a secondary transfer means adapted to create the secondary transfer portion between it and the intermediate transfer belt 50, and 67 a cleaning blade as a cleaning means adapted to remove portions of the toner remaining on the surface of the intermediate transfer belt 50 after the secondary transfer.

And now, the present invention is concerned with the optical system for such a line head (optical write line head) as described above. First of all, the principles are explained.

Figure 12A:
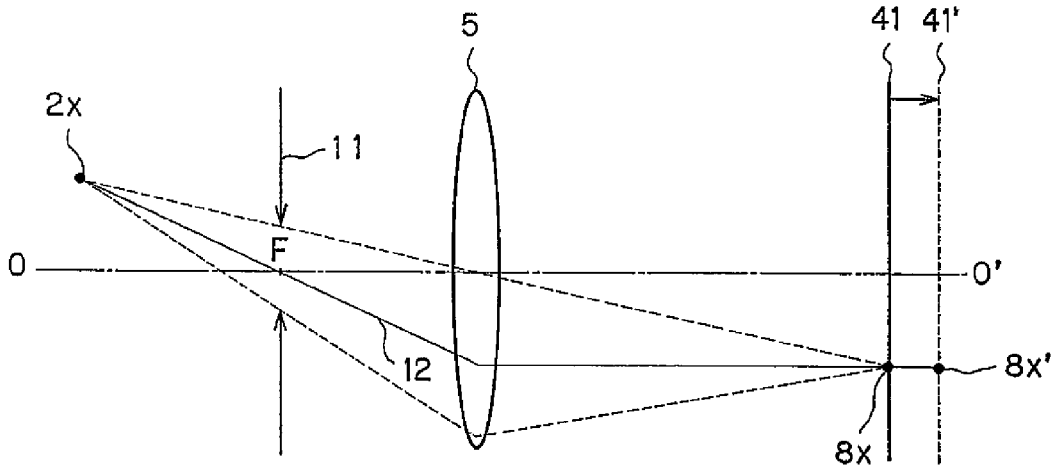
FIG. 12 is illustrative of the principles of the invention.
Figure 12B:
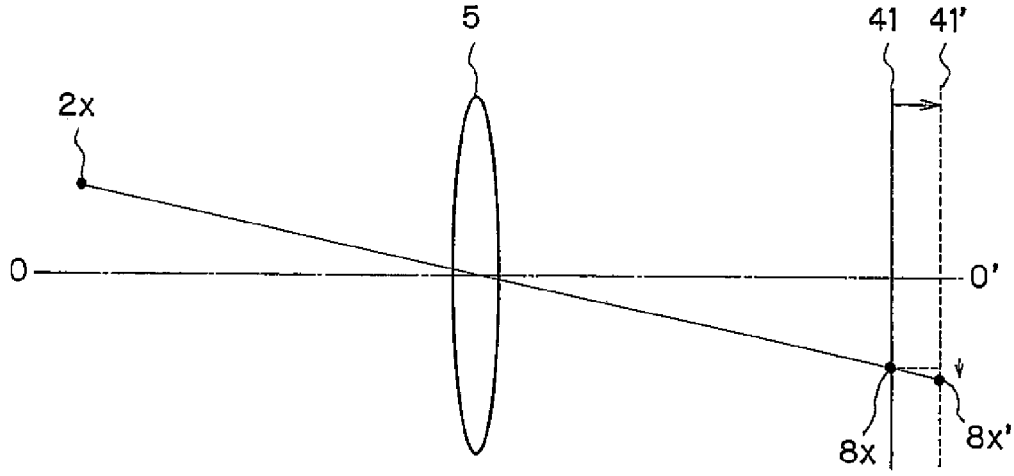

FIG. 12 is illustrative of the principles of the invention. More specifically, FIG. 12 is illustrative of what relations an end light emitter device 2*x* of a row of light emitter devices lined up in the line head has to the photosensitive member (image carrier) 41 onto which that row of light emitter devices is projected: FIG. 12(*a*) is about the invention and FIG. 12(*b*) is about the prior art. Generally in the prior art of FIG. 12(*b*), the aperture of a microlens 5 is defined by its contour shape; that is, an imaging spot 8*x* that is an image of the end light emitter device 2*x* on the photosensitive member 41 is formed on a straight line passing through the end light emitter device 2*x* and the center of the microlens 5. Accordingly, as the plane of the photosensitive member 41 that is the image plane moves to a position 41' of FIG. 12(*b*) while budging forth and back in an optical axis O-O' through the lens due to the vibration or the like of the photosensitive member, it causes the position of the imaging spot 8*x* on the photosensitive member 41 to shift to a position 8*x*' on that straight line, giving rise to an imaging spot misalignment. Consequently, there is a variation in the pitch between scan lines drawn by the relative movement of that imaging spot 8*x* in the subordinate scan direction (a pitch variation of the imaging spot in the main scan direction).

In the invention, therefore, an aperture stop 11 is located at a position of a front focus F of the microlens 5 and coaxially with the optical axis O-O', as shown in FIG. 12(*a*). As such aperture stop 11 is located at the position of the front focus F of the microlens 5, a chief ray 12 from the end light emitter device 2*x* is going to pass through the center of the aperture stop 11, traveling parallel with the optical axis O-O' after refracted through the microlens 5. Even when the photosensitive member 41 shifts to the position 41' in the optical axis O-O' direction, the position of the imaging spot 8*x* on the photosensitive member 41 becomes a position 8*x*' of the chief ray 12 after refraction through the microlens 5; even when the position of the photosensitive member 41 budges forth and back, there is no misalignment of the imaging spot 8*x*. For this reason, there is none of such a pitch variation of the imaging spot 8*x* in the main scan direction as found in the prior art, and there is none of the pitch variation between the scan lines drawn by the movement of the imaging spot 8*x* in the subordinate scan direction, either.

That is to say, the present invention provides a line head comprising a plurality of light emitter devices lined up in a main scan direction and one positive lens located corresponding to the plurality of light emitter devices with an image (an imaging spot array) of that row of light emitter devices projected onto a projection plane (photosensitive member) to form an image, wherein a projection optical system is designed as a so-called telecentric arrangement on an image side so that even when the position of the projection plane (photosensitive member) is displaced in an optical axis direction, an imaging spot misalignment is staved off thereby preventing deterioration of the resulting image.

The requirement for the aperture stop 11 is that it has a shape enough to limit an aperture diameter in a direction (main scan direction) where at least an off-axis imaging spot misalignment becomes a problem; when an array comprising one row of light emitter devices is located with one positive lens as in the prior art (Patent Publications 1 and 2), it may as well have a shape just enough to limit the aperture diameter in the main scan direction. Even when there are two arrays provided very closely in the subordinate scan direction as in the aforesaid embodiment of the invention (FIG. 4), the aperture stop may have a shape just enough to limit the aperture diameter in the main scan direction. Of course, the aperture stop may just as well have such a shape to limit the aperture diameter in the subordinate scan direction. To this end, the aperture stop may preferably have a circular, oval, or rectangular shape.

Figure 13:
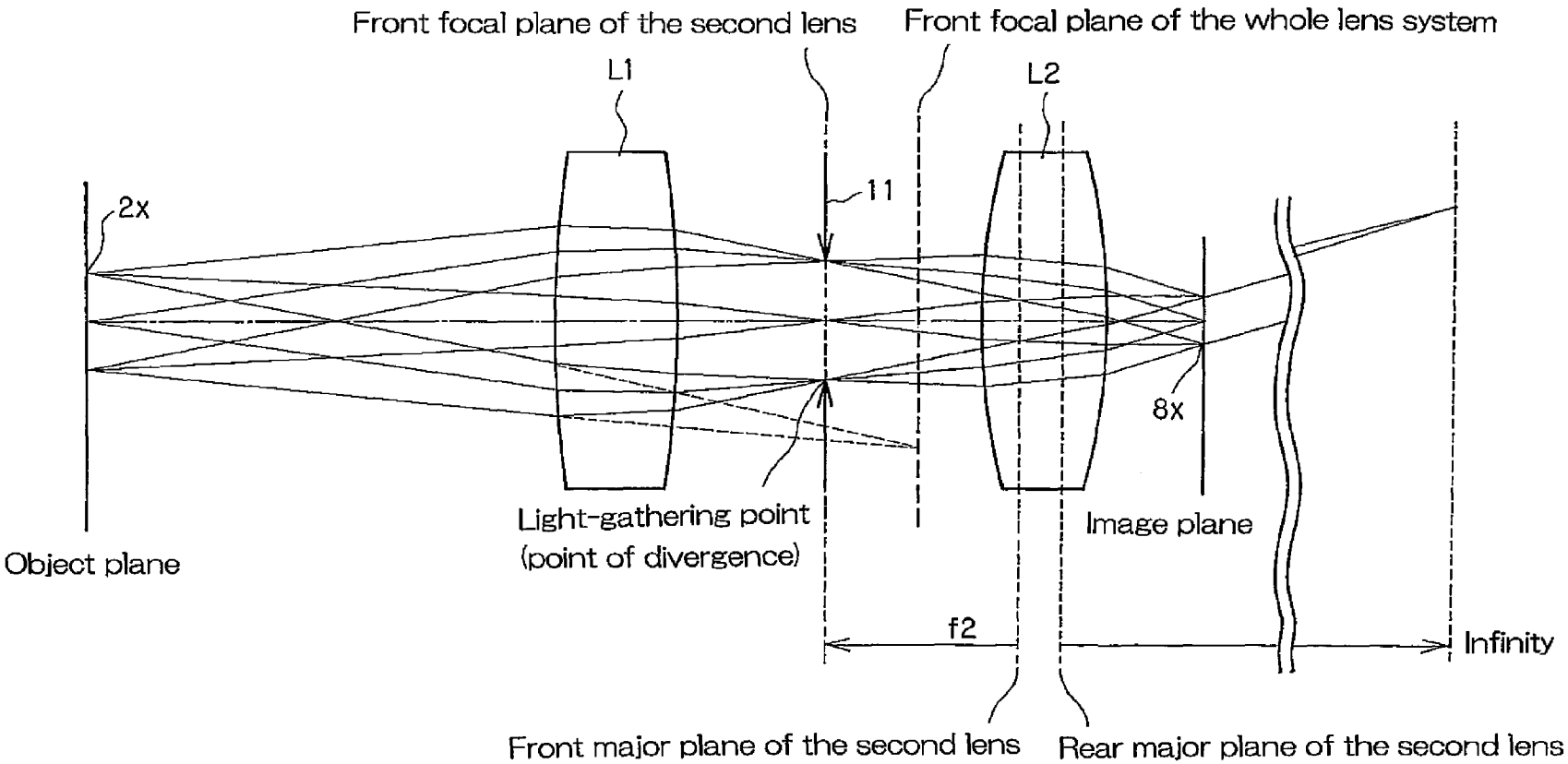
FIG. 13 is illustrative of where to locate the aperture stop in the case where the microlens is made up of a lens system comprising two positive lenses.

Although FIG. 12 has been explained on condition that the microlens 5 is made up of one positive lens, it is to be understood that it may as well be a lens system of positive refracting power comprising at least two coaxially located lenses. And when such a lens system is used as the microlens 5 with its front focus F positioned in front of that lens system (on the object side), the aperture stop may as well be located at that front focus F. When the front focus F of that lens system is within it, the aperture stop 11 may as well be located at a position where parallel light incident from the image side comes together actually.

Where the apertures stop 11 is to be located with a lens system comprising two positive lenses L1 and L2 as the microlens 5 is now explained with reference to FIG. 13. When the microlens 5 is made up of a combination of the first lens L1 and the second lens L2 in order from its object side, a light beam (parallel light) emanating at infinity on the image side of the second lens L2 comes together at the front focal plane of the second lens L2, and is then incident from that light-gathering point on the first lens L1 in the form of diverging light, leaving it toward the object side with its angle of divergence slackened. In this case, if the aperture stop 11 is located at the plane of that light-gathering point (the front focal plane of the second lens L2), there is then a telecentric setup achieved on the image side, wherein even when the position of the projection plane (photosensitive member) is in axial misalignment, there is no misalignment of the imaging spot, which prevents deterioration of the resultant image.

And now, the image of the aforesaid light-gathering point (divergent light) is a virtual image as viewed from the object side, and a plane with that virtual image existing at it is the front focal plane of the whole lens system. Accordingly, the image of the aperture stop 11 located at the plane of that light-gathering point, too, is going to be positioned at the front focal plane of the whole lens system. That is, now that the image of the aperture stop 11 as viewed from the image-object side is an entrance pupil, the setup having the entrance pupil of the lens system located at the front focal plane of the whole lens system can be telecentric on the image side.

That it can be preferable to locate the entrance pupil at the front focal plane of the whole lens system, and that it can be preferable to locate the aperture stop 11 at a position where parallel light incident from the image side comes together actually, indeed, holds for the case where the front focus F is positioned in front of the lens system (on the object side).

That is to say, being telecentric on the image side is tantamount to locating the aperture stop 11 at a position where parallel light incident from the image side comes together actually, and locating the entrance pupil at the front focal plane of the whole lens system.

While the optical system for the optical write line head has been described, the same holds for an optical system having an optical path just opposite to what has been described: an optical read line head wherein a plurality of light receptor devices are lined up in the main scan direction and one positive lens is located with such multiple light receptor devices so that the image of the row of light receptor devices (an array of read spots) is back projected onto a read plane to read an image. That is, if that projection optical system is designed to be telecentric on the object side, the read spot is then unlikely to misalign even with the position of the read plane misaligning in the optical axis direction, thereby preventing deterioration of the read image. In FIG. 12(*a*) in this case, reference numeral 41 stands for the read plane, and 2*x* stands for the end light receptor device with the principles being the same as those of the optical write line head.

The optical write line head according to one example to which the principles of the invention are applied is now explained.

Figure 14:
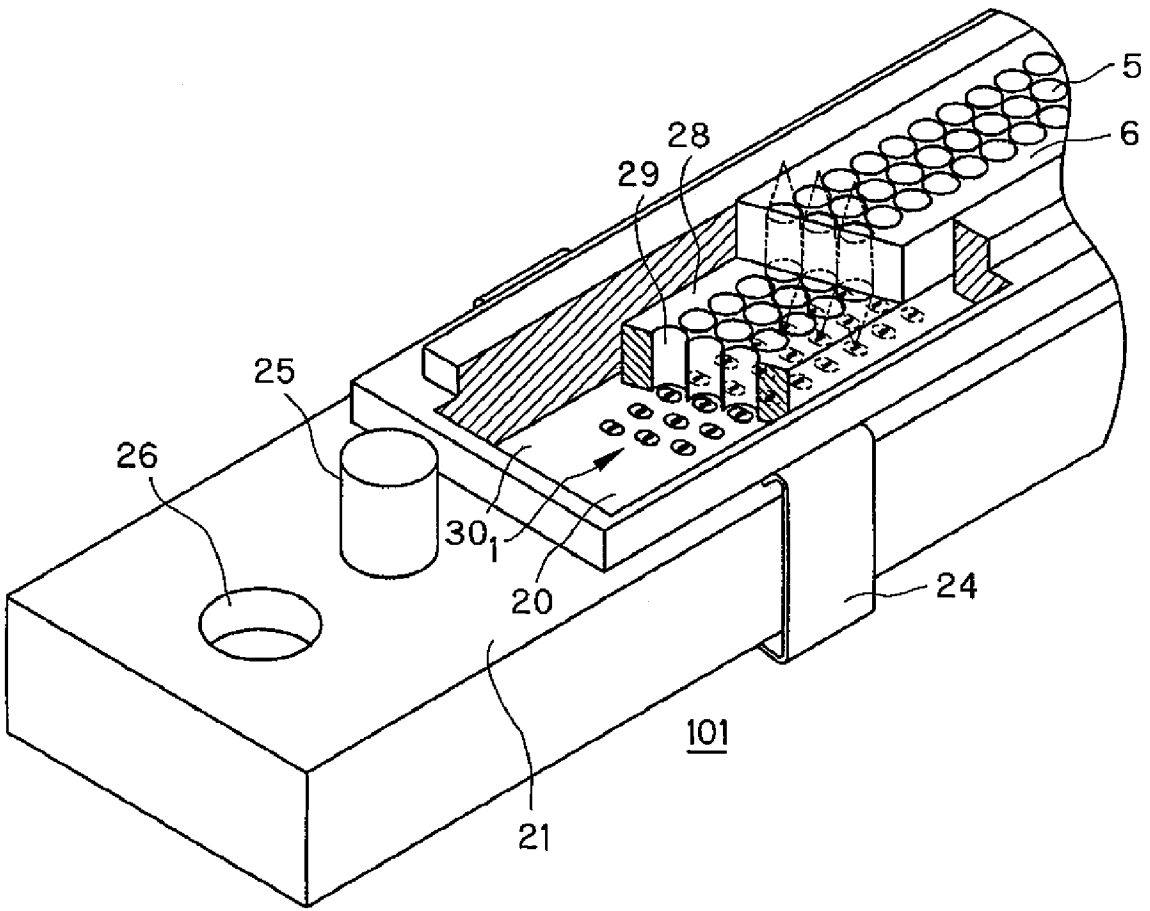
FIG. 14 is a partly broken away perspective view of the setup of the optical write line head according to one example of the invention.
Figure 15:
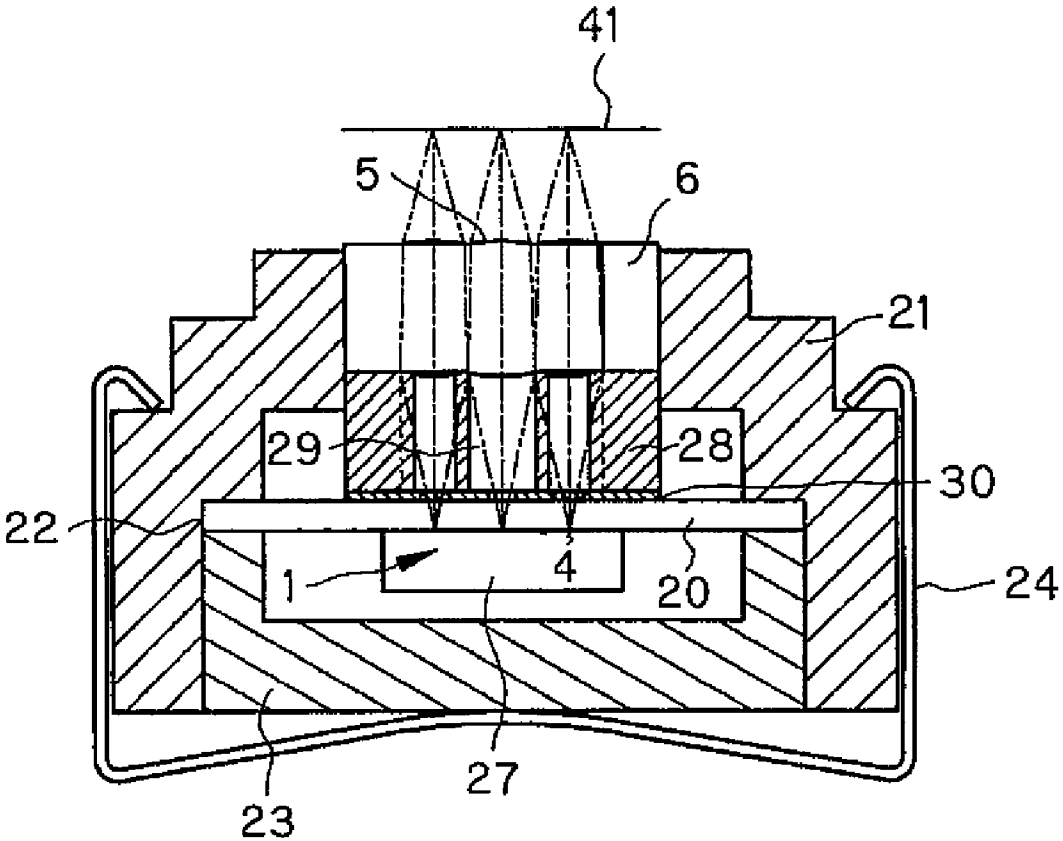
FIG. 15 is a sectional view of FIG. 14 as taken along the subordinate scan direction.
Figure 16:
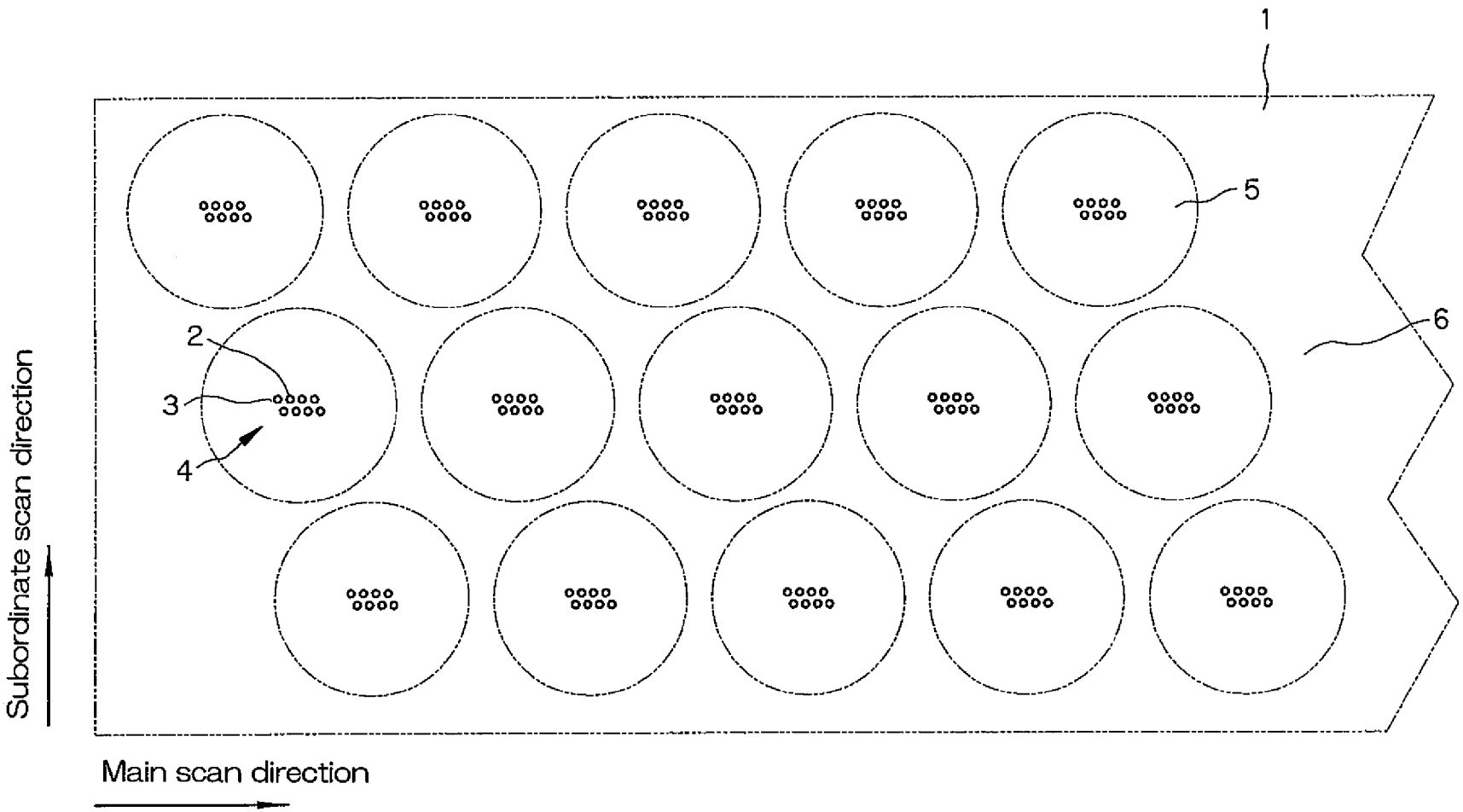
FIG. 16 is a plan view of the arrangement of the light emitter array and the microlens array in FIG. 14.
Figure 17:
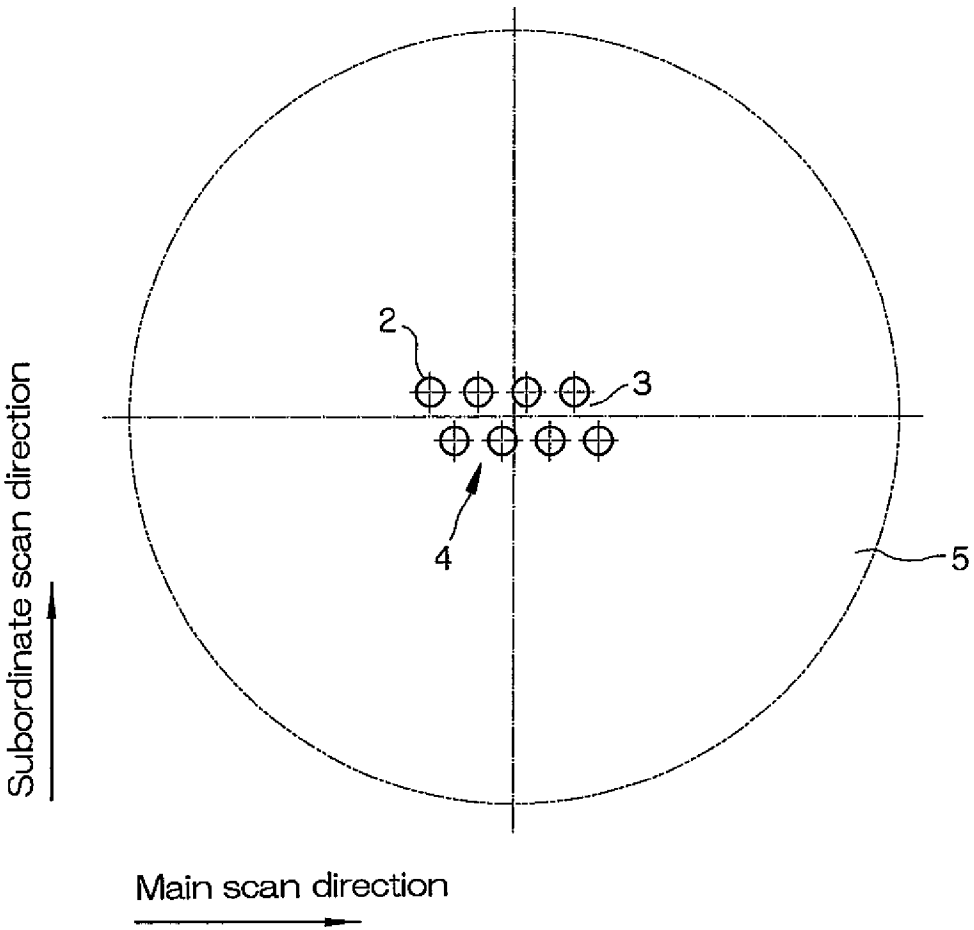
FIG. 17 is illustrative of what relation one micro-lens has to the corresponding light emitter block.

FIG. 14 is a partly broken away perspective view of the setup of the optical write line head according to that example, and FIG. 15 is a sectional view of FIG. 14 as taken along the subordinate scan direction. FIG. 16 is a plane view of the arrangement of a light emitter array and a microlens array, and FIG. 17 is illustrative of what relations one microlens corresponds to a light emitter block in.

In the example here, as in FIGS. 4 and 7, a row 3 of four light emitter devices 2 lined up in the main scan direction is provided. Two such rows 3 are formed in the subordinate scan direction into one light emitter block 4. A plurality of such light emitter blocks 4 are provided in the main, and the subordinate scan direction to define a light emitter array 1. The light emitter blocks 4 are arrayed in a zigzag fashion where the foremost blocks are offset in the main, and the subordinate scan direction. In the example of FIG. 16, three rows of light emitter blocks 4 are provided in the subordinate scan direction. Such light emitter array 1 is formed on the back surface of a glass substrate 20, and driven by a drive circuit formed on the same back surface of the glass substrate 20. Note here that the organic EL devices (light emitter devices 2) are sealed up by a sealing member 27.

The glass substrate 20 is fitted in a recess 22 formed in an elongate casing 21, and fixed there by means of a fixture 24 together with a back lid 23. More specifically, alignment pins 25 provided at both ends of the elongate casing 21 are inserted through opposite alignment holes in the imaging apparatus body, and fixing screws are screwed into threaded holes in the imaging apparatus body by way of threaded holes 26 formed through both ends of the elongate casing 21, whereby an optical write line head 101 is fixed in place.

And a microlens array 6 is fixed on the surface side of the glass substrate 20 in the casing 21 by way of a light shield member 28 having given thickness and provided with through-holes 29 formed in such a way as to be in alignment with each light emitter block 4 on the light emitter array 1. In this case, as can be seen from FIG. 17, the microlens array 6 is fixed in such a way that the optical axis through each microlens 5 on the microlens array 6 is in alignment with the center of the light emitter block 4.

Figure 18:
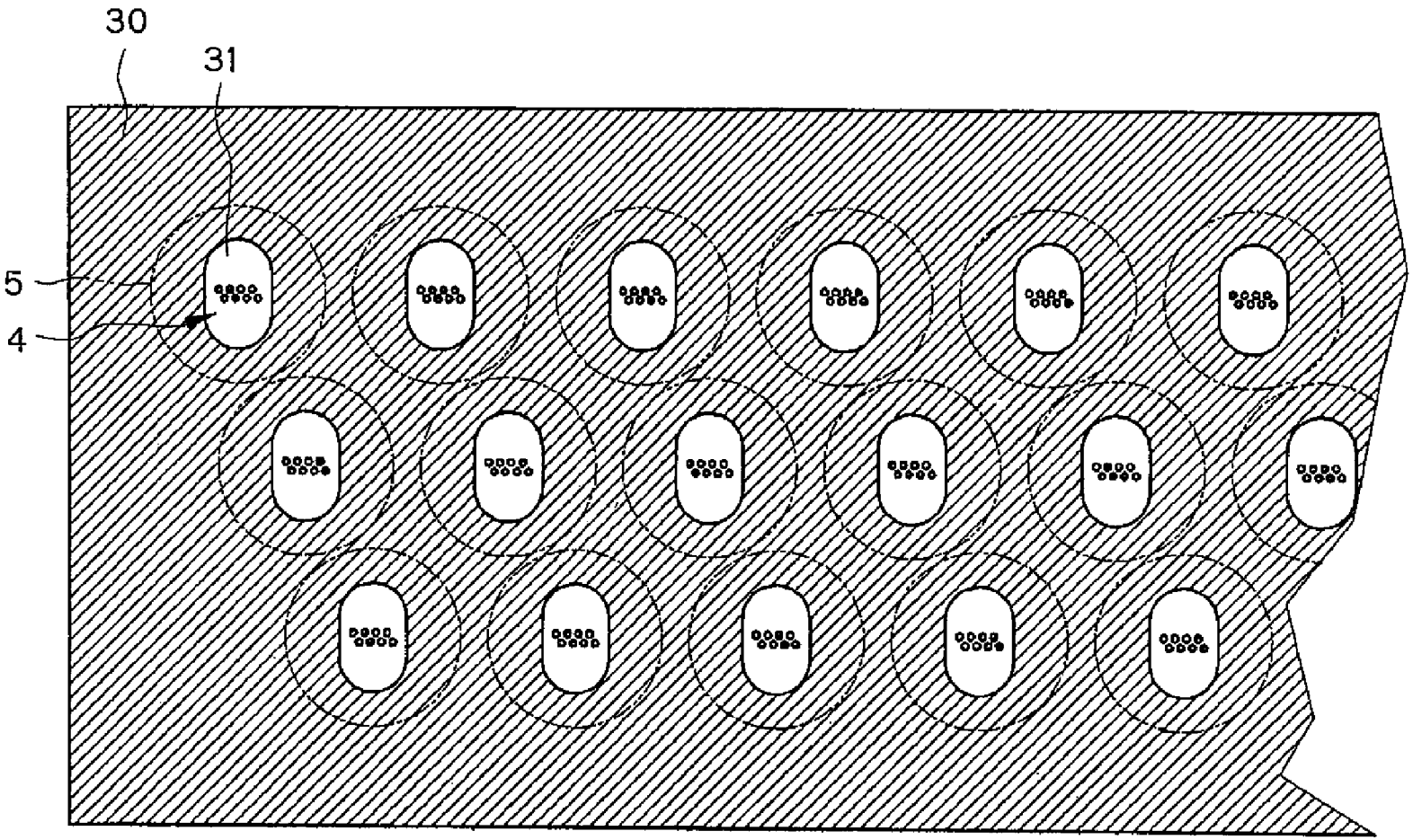
FIG. 18 is a plan view of the stop plate located corresponding to the light emitter block in the light emitter array.
Figure 19:
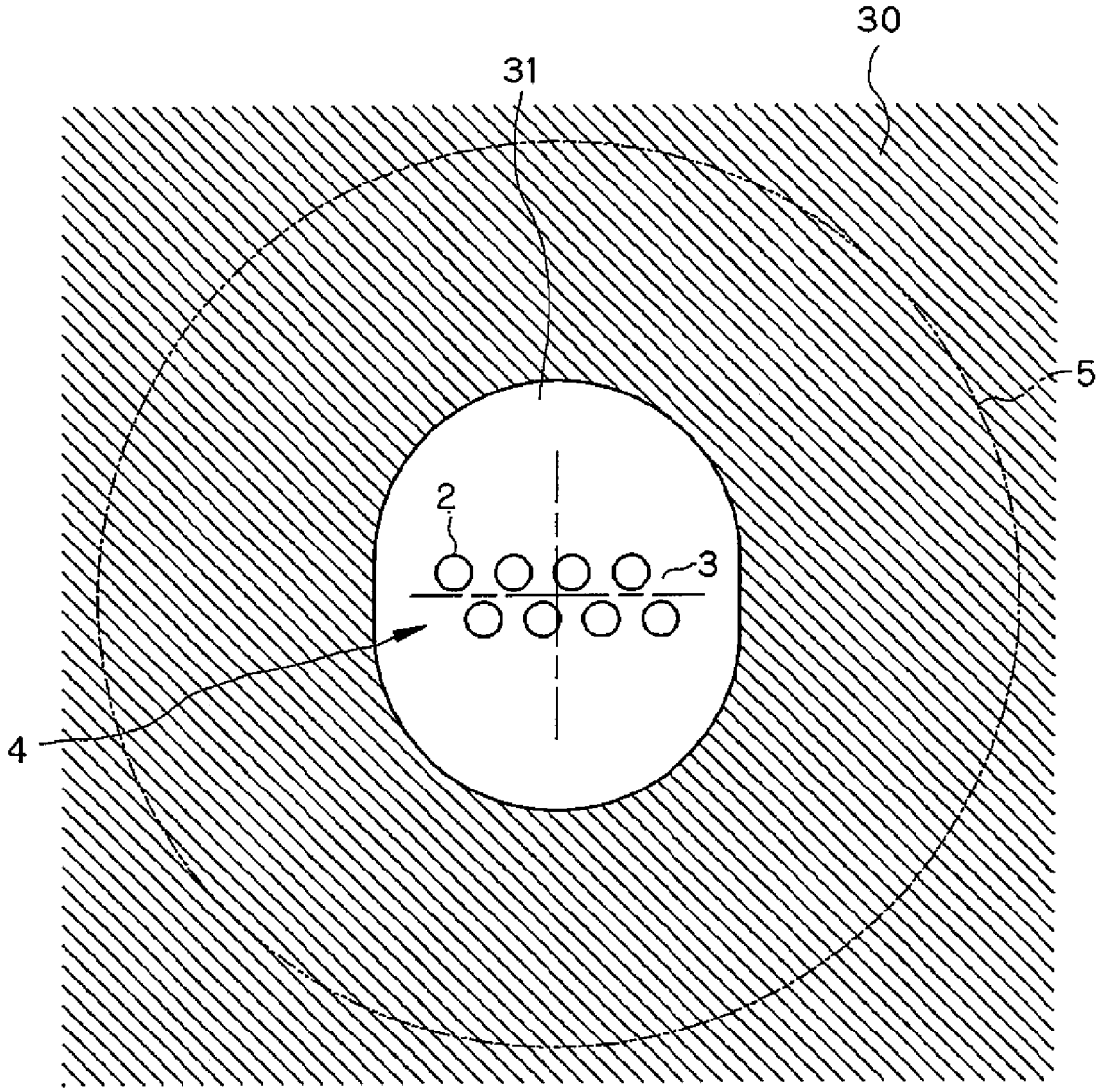
FIG. 19 is illustrative of the aperture in the stop plate with respect to one light emitter block.
Figure 20:
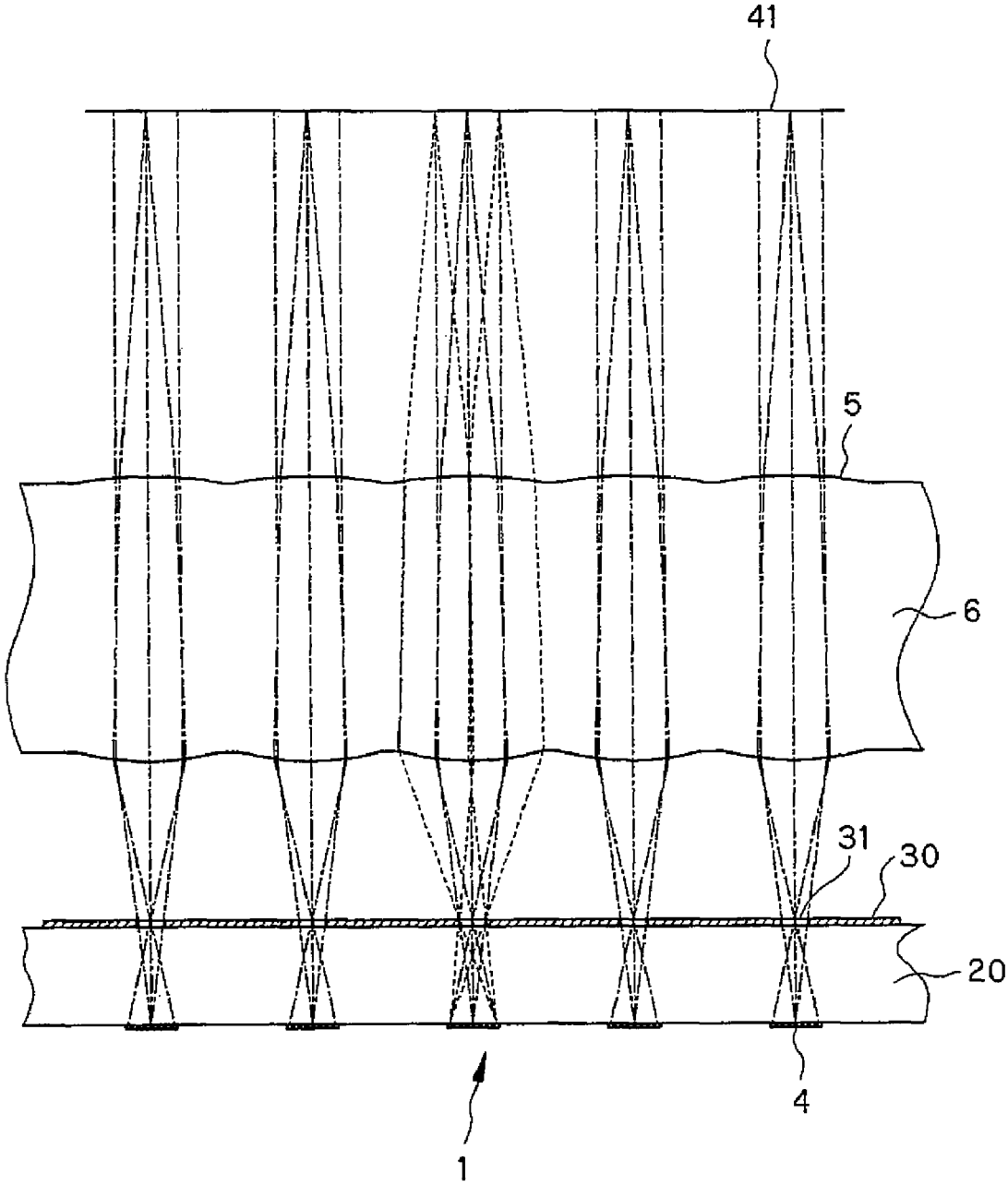
FIG. 20 is illustrative of an optical path taken by light from the light emitter devices forming each light emitter block through the aperture in the stop plate and the microlenses on the microlens array.

And on the basis of the invention, the thickness of the glass substrate 20 and the thickness of the light shield member 28 are selected in such a way that the surface position of the glass substrate 20 is in alignment with the front focus F of the microlens 5 (FIG. 12(*a*)), and a stop plate 30 is brought in close contact with, and located over, the surface of the glass substrate 20. Details of the stop plate 30 are illustrated in FIGS. 18 and 19. FIG. 18 is a plan view of the stop plate 30 located in correspondence to the light emitter block 4 on the light emitter array 1, and FIG. 19 is illustrative of an aperture 31 in the stop plate 30 relative to one light emitter block 4. FIG. 20 is an optical path diagram indicative of optical paths taken by light traveling from the light emitter devices 2 defining each light emitter block 4 through the apertures 31 in the stop plate 30 and the microlenses 5 on the microlens array 6. The apertures 31 are provided in alignment with the center (optical axis) of each microlens 5 on the microlens array 6 and the center of the light emitter block 4. In this example, each aperture 31 is configured into an almost oval shape enough to set the aperture diameter in the main scan direction larger than that in the subordinate scan direction; however, it may as well be configured to a circular, oval, rectangular or other shape.

In the example here, the stop plate 30 is brought in intimate contact with, and located over, the surface of the glass substrate 20, as described above, so that alignment, upkeep, etc. are facilitated. The stop plate 30 may be a separate one or, alternatively, it may be provided as a one piece to the surface of the glass substrate 20 by means of vapor deposition, printing or the like.

Figure 21:
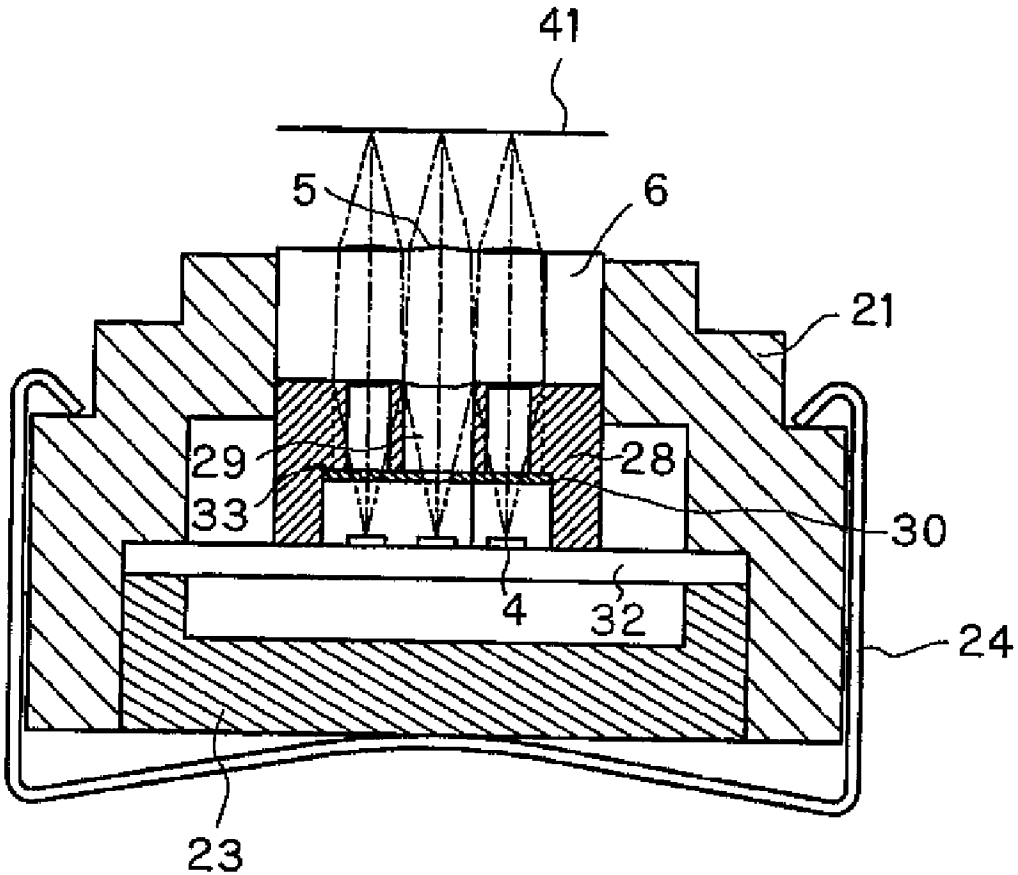
FIG. 21 is a view corresponding to FIG. 15 in an embodiment wherein LEDs or the like are used.
Figure 22:
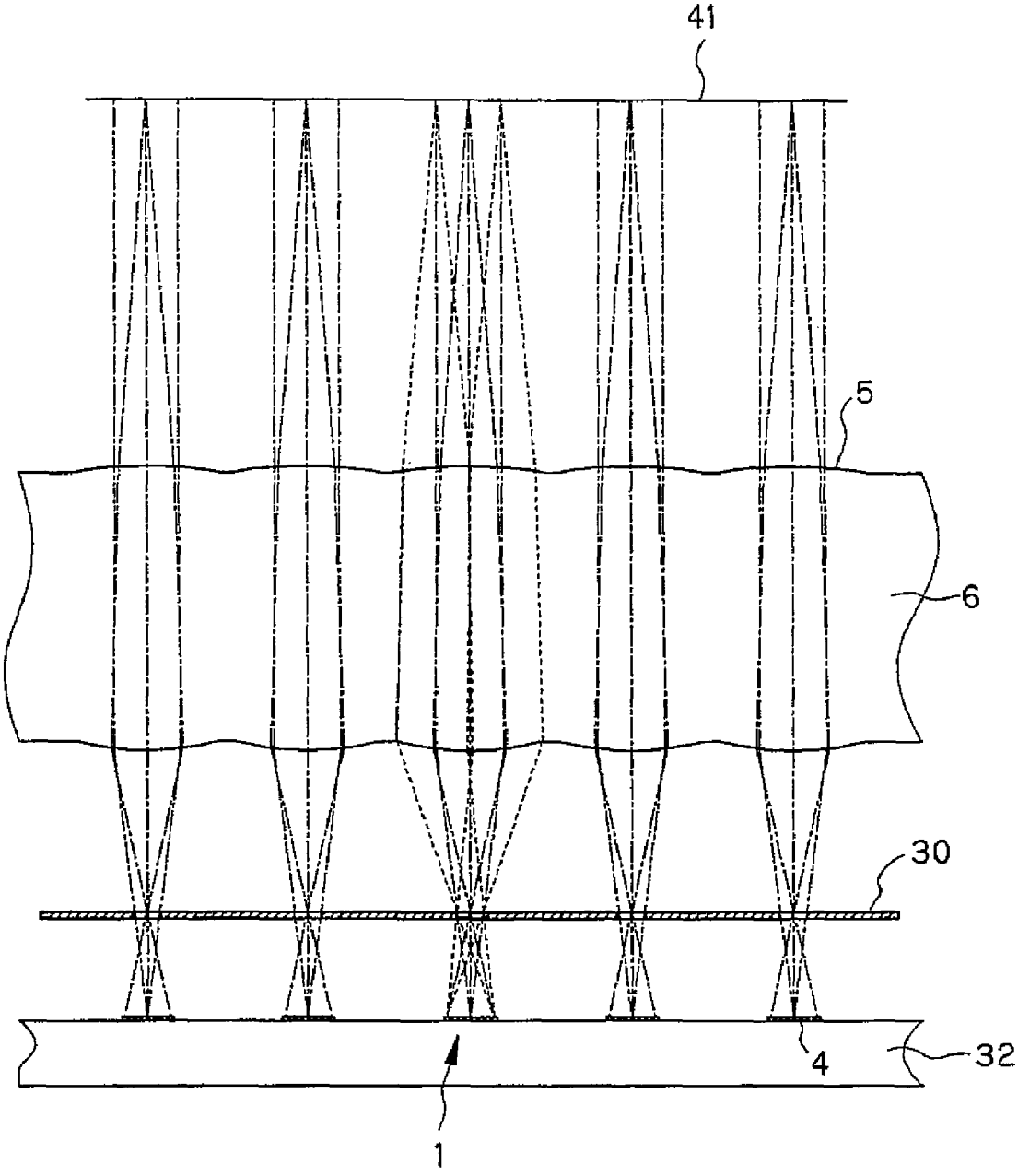
FIG. 22 is a view corresponding to FIG. 20 in an embodiment wherein LEDs or the like are used.

While the foregoing example is directed to the so-called bottom emission type optical write line head 101 that harnesses light emitted out of the organic EL devices located on the back side of the glass substrate 20 as the light emitter devices 2 and directing toward the surface side of the glass substrate 20, it is understood that when EL devices or LEDs are located as the light emitter devices on the surface side of a substrate 32, the invention may be set up as shown in FIGS. 21 and 22 that are corresponding to FIGS. 15 and 20, respectively. In this case, the stop plate 30 must be located in space between the plane of the light emitter devices 2 (light emitter block 4) and the microlens array 6. It is then desired that to position and support the stop plate 30 at the front focal position of the microlens 5, the stop plate 30 be engaged and fixed in a receiving surface 33 formed at the light shield member 28.

Figure 23:
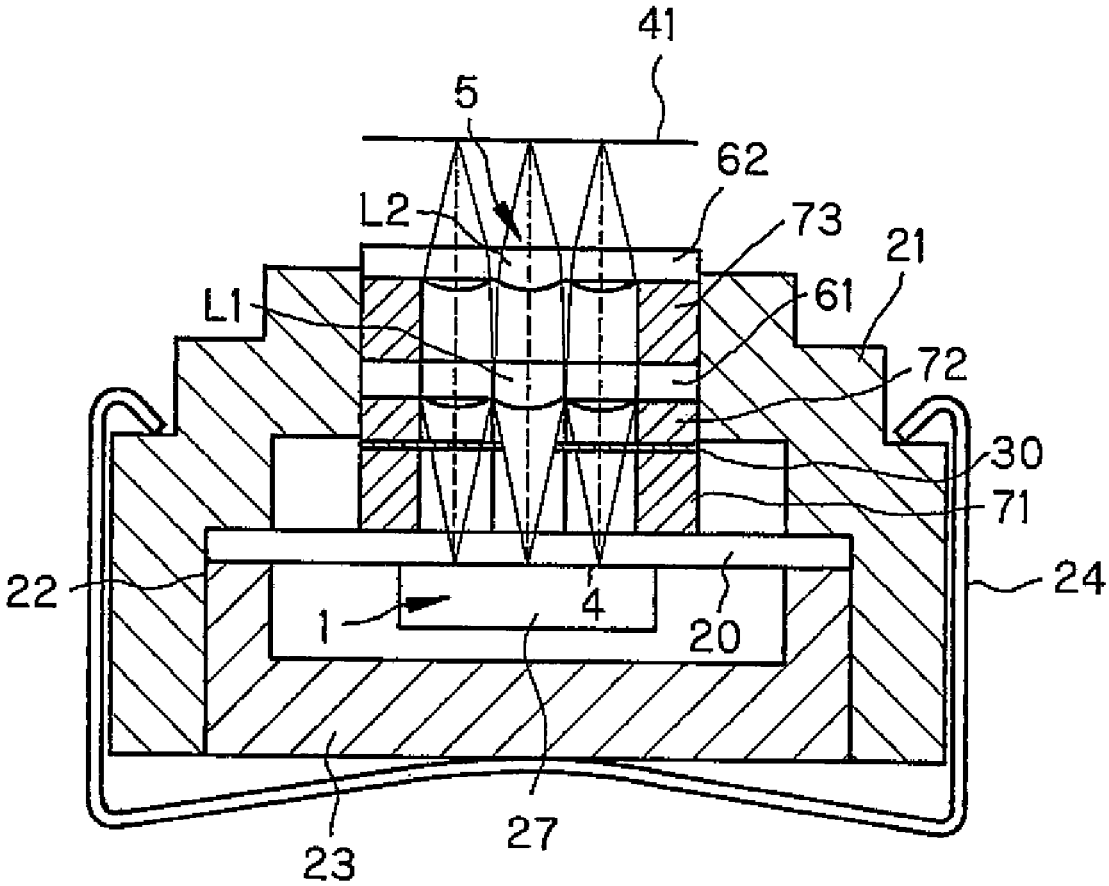
FIG. 23 is a sectional view, as taken along the subordinate scan direction, of an embodiment of the optical write line head wherein the microlens is made up of a lens system comprising two positive lenses, and the stop plate is located at the front focal plane of that lens system.

As already stated, the microlens 5 may be made up of, not one positive lens, a lens system of positive refracting power comprising at least two coaxially located lenses. In this case, the stop may be located either on the object side (in front of) of the lens system or within the lens system. FIG. 23 is a sectional view, as taken along the subordinate scan direction as in FIG. 15, of an example of the optical write line head wherein the micro-lens 5 is a lens system made up of two positive lenses L1 and L2 and the stop plate 30 is located on the front focal plane of the lens system made up of the positive lenses L1 and L2. In the example here, the stop plate 30 provided with apertures 31 (FIGS. 18 and 19) via the first spacer 71 in such a way as to be in alignment with the center of each light emitter block 4 on the light emitter array 1 is located on the surface side of the glass substrate 20 in the casing 21. The first microlens array 61 composed of the positive lenses L1 is provided over the stop plate 30 via the second spacer 72 in such a way that the center of each light emitter block 4 on the light emitter array 1 is in alignment with each positive lens L1, and the second microlens array 62 composed of the positive lenses L2 is fixed onto the first microlens array 61 via the third spacer 73 in such a way that the center of each light emitter block 4 on the light emitter array 1 is in alignment with each positive lens L2.

Figure 24:
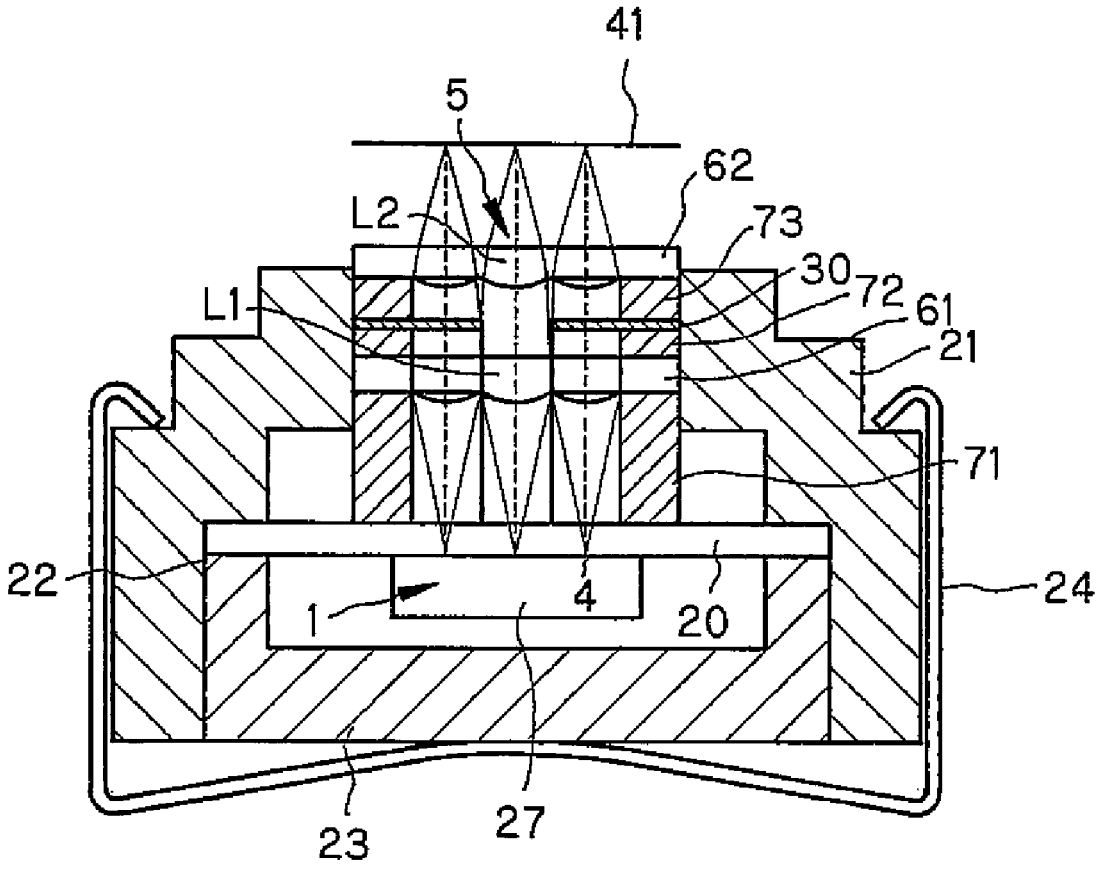
FIG. 24 is a sectional view, as taken along the subordinate scan direction, of an embodiment of the optical write line head wherein the microlens is made up of a lens system comprising two positive lenses, and the stop plate is located between them.

FIG. 24 is a sectional view, as taken along the subordinate scan direction as in FIG. 15, of an example of the optical write line head (FIG. 13) wherein the micro-lens 5 is a lens system made up of two positive lenses L1 and L2 and the stop plate 30 is located at the front focal plane of the positive lens L2 between the positive lenses L1 and L2. In the example here, the first microlens array 61 composed of the positive lens L1 in such a way that the center of each light emitter block 4 on the light emitter array 1 is in alignment with the positive lens L1 is located via the first spacer 71 on the surface side of the glass substrate 20 in the casing 21. The stop plate 30 provided with apertures 31 in such a way as to be in alignment with the center of each light emitter block 4 on the light emitter array 1 is located via the second spacer 72 on the first microlens array 61, and the second micro-lens array 62 composed of the positive lens L2 in such a way that the center of each light emitter block 4 on the light emitter array 1 is in alignment with the positive lens L2 is fixed via the third spacer 73 on the stop plate 30.

In the example of FIGS. 23 and 24, the microlens array 6 adapted to project the rows of light emitter devices on each light emitter block 4 may comprise a combination of the first microlens array 61 with the second microlens array 62.

Figure 25:
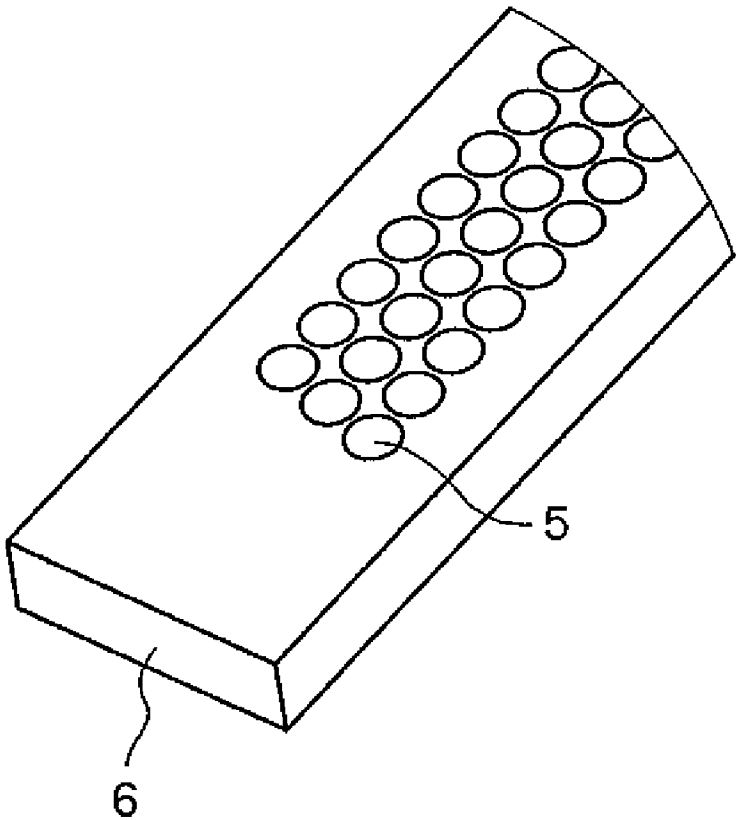
FIG. 25 is a perspective view of one example of the microlens array.
Figure 26:
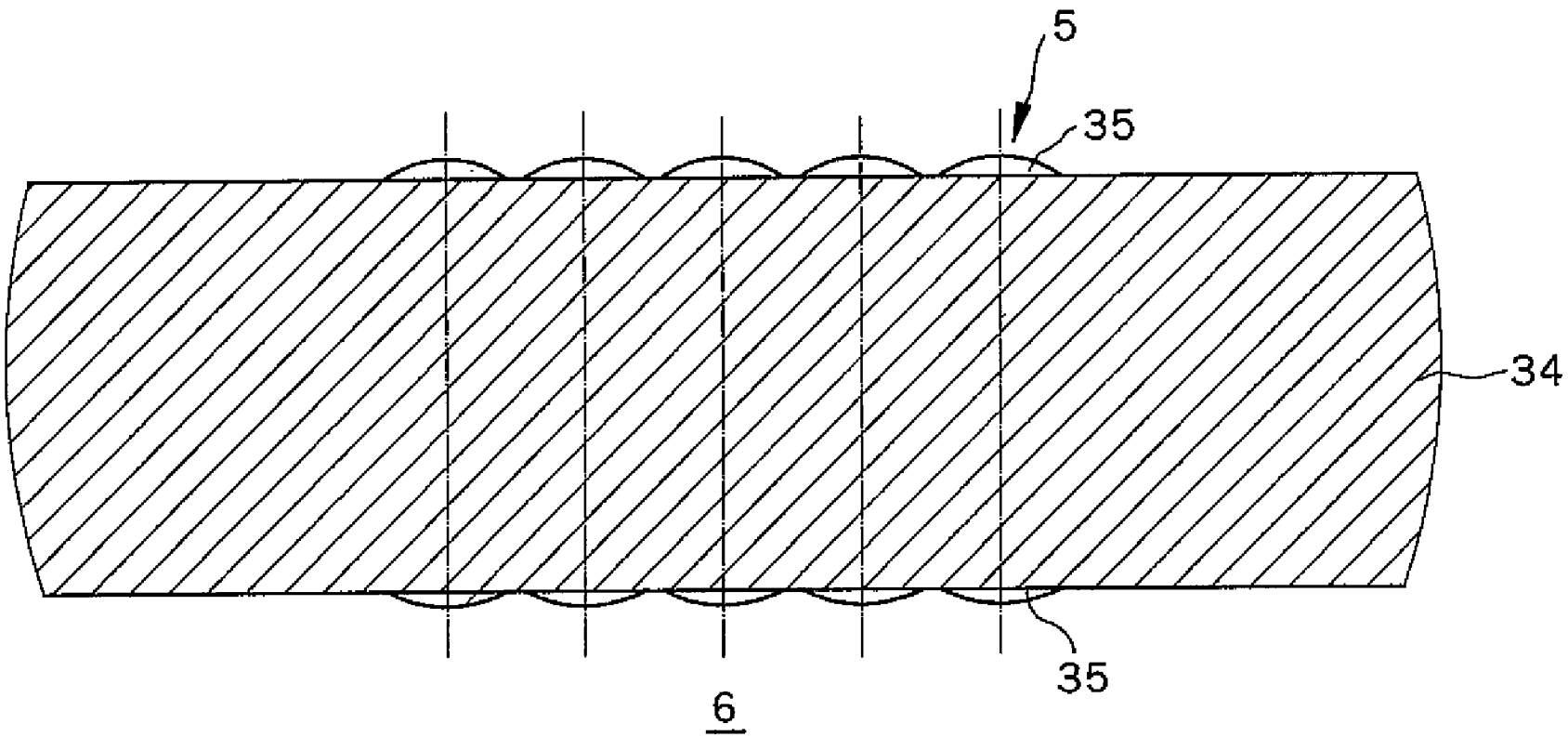
FIG. 26 is a sectional view of the microlens array of FIG. 15 as taken along the main scan direction.

And now, the microlens array 6, 61, 61 used for the optical write line head 101 of the invention may be of any desired construction used so far in the art: one example is shown in FIGS. 25 and 26. FIG. 25 is a perspective view of the microlens array 61, and FIG. 26 is a sectional view of that array as taken along the main scan direction. In this example, the respective microlenses 5 are defined by lens surface portions 35 made up of transparent resins formed in alignment and integrally on both surfaces of a glass substrate 34. The lens surface portions 35 may either be all formed of convex surfaces or be formed of concave surfaces on one side.

Figure 27:
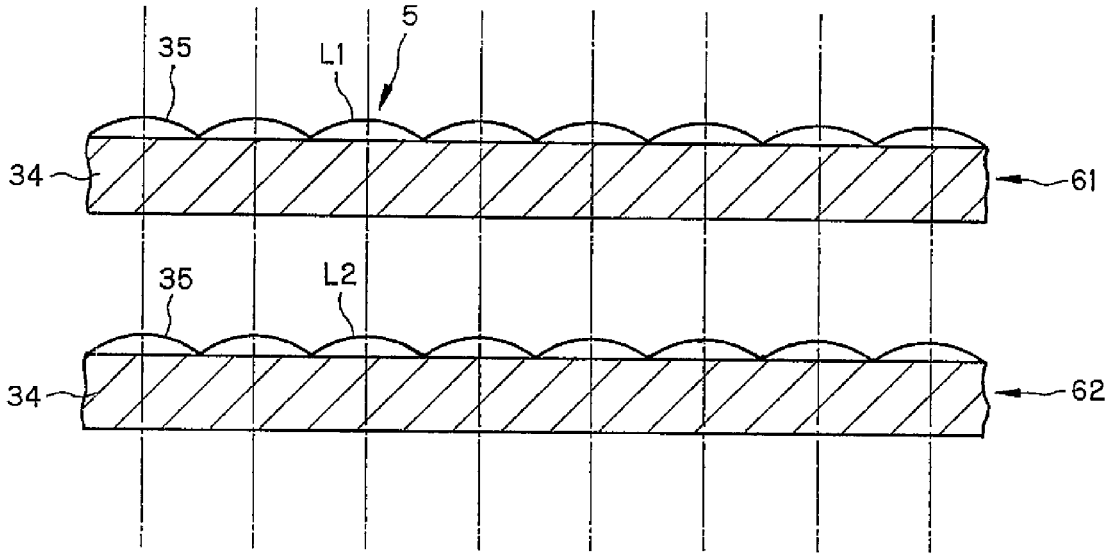
FIG. 27 is a sectional view, as taken along the main scan direction, of an example of using two microlens arrays.

FIG. 27 is a sectional view, as taken along the main scan direction, of the microlens array 6 (FIGS. 23 and 24) wherein the first and second microlens arrays 61 and 62 are combined together in such a way that the respective micro lenses L1 and L2 are coaxially lined up. In this example, lens surface portions 35 formed of transparent resin are integrally formed on one surface (object side surface) of the glass substrate 64 of the respective microlens arrays 61, 62 to form the respective micro lenses L1 and L2. In the case of FIGS. 23, 24 and 27, by configuring the image-side surface of the second microlens array 62 into a flat surface, its cleaning capability can be so improved when it is used as the one for the line head of, e.g., an imaging apparatus, because even when a developer toner is scattered off for deposition onto that flat plane, it can be easily cleaned off.

Specific numerical examples of the optical system used in the aforesaid embodiments are now given as Examples 1 to 6.

Figure 28:
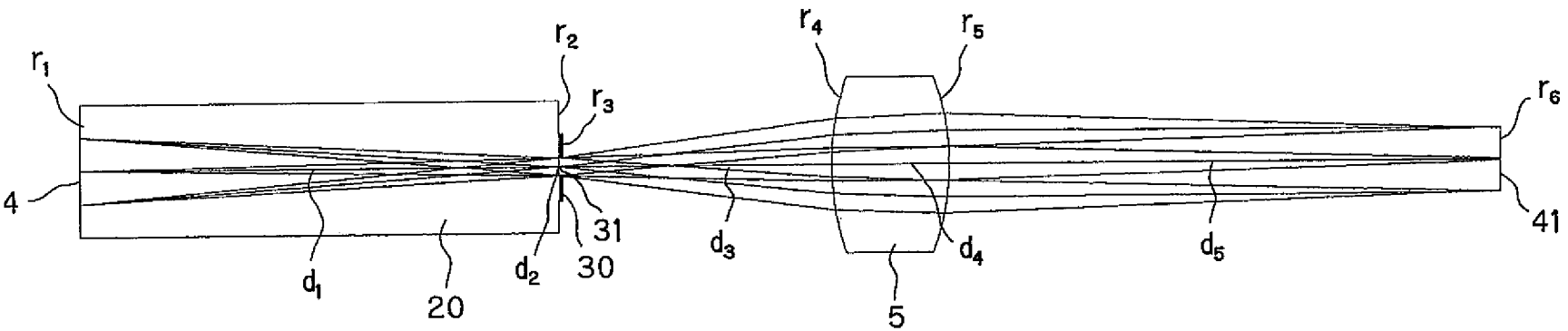
FIG. 28 is a sectional view, as taken along the main scan direction, of the optical system corresponding to one microlens in Example 1.
Figure 29:
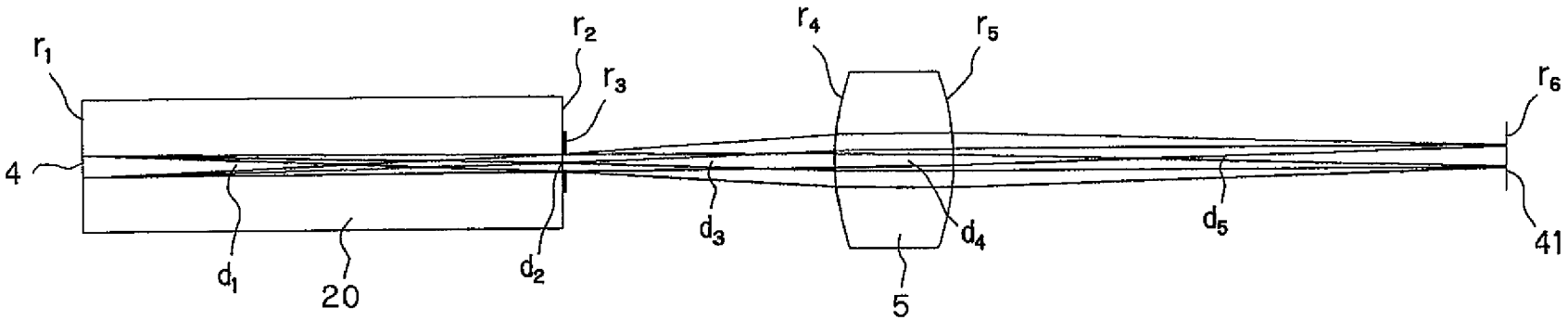
FIG. 29 is a sectional view, as taken along the subordinate scan direction, of the optical system corresponding to one microlens in Example 1.

FIGS. 28 and 29 are sectional views of the optical system corresponding to one microlens 5 in Example 1 as viewed in the main, and the subordinate scan direction, respectively. Organic EL devices are used as the light emitter devices 2, and the stop plate 30 is brought into intimate contact over the surface of the glass substrate 20. There are numerical data given below about this example wherein, as viewed in order from the side of the light emitter block 4 toward the side of the photo-sensitive member (image plane) 41, $r_1$, $r_2$, . . . are the radii of curvature of the respective optical surfaces (in mm), $d_1$, $d_2$, . . . are the spaces between adjacent optical surfaces (in mm), $n_{d1}$, $n_{d2}$, . . . are the d-line refractive indices of the respective transparent media, and $\nu_{d1}$, $\nu_{d2}$, . . . are the Abbe numbers of the respective transparent media. Throughout the data, $r_1$, $r_2$, . . . stand for optical surfaces.

In the optical system of Example 1, the optical surface $r_1$ is the light emitter block (object plane) 4, the optical surface $r_2$ is the front surface of the glass substrate 20, the optical surface $r_3$ is the aperture 31 in the stop plate 30, the optical surfaces $r_4$ and $r_5$ are the object-side and image-side surfaces of the microlens 5, and the optical surface $r_6$ is the photosensitive member (image plane) 41.

Figure 30:
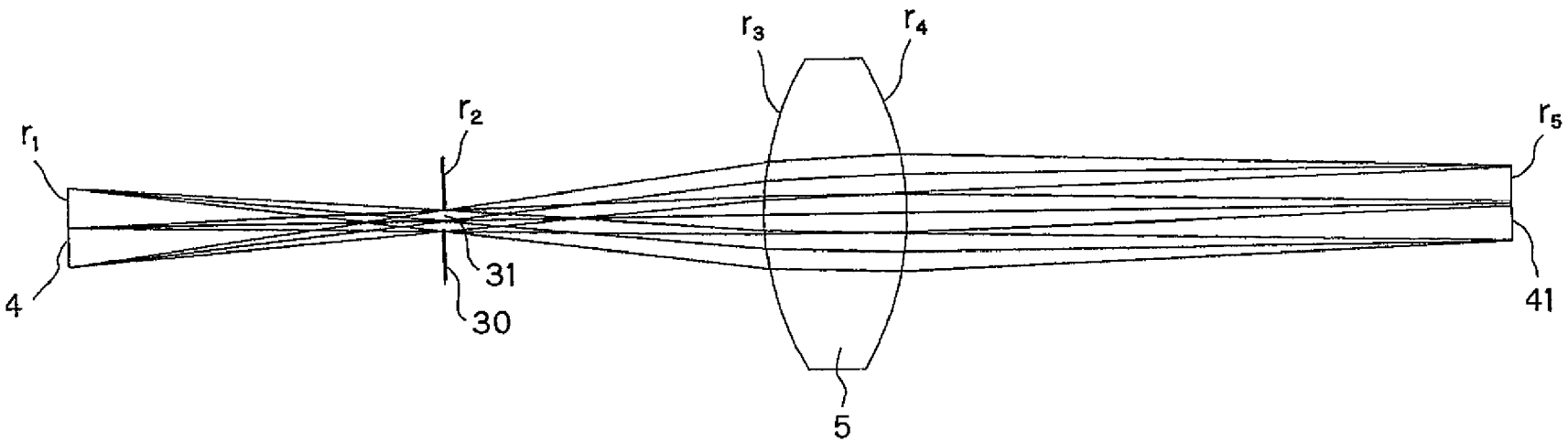
FIG. 30 is a sectional view, as taken along the main scan direction, of the optical system corresponding to one microlens in Example 2.
Figure 31:
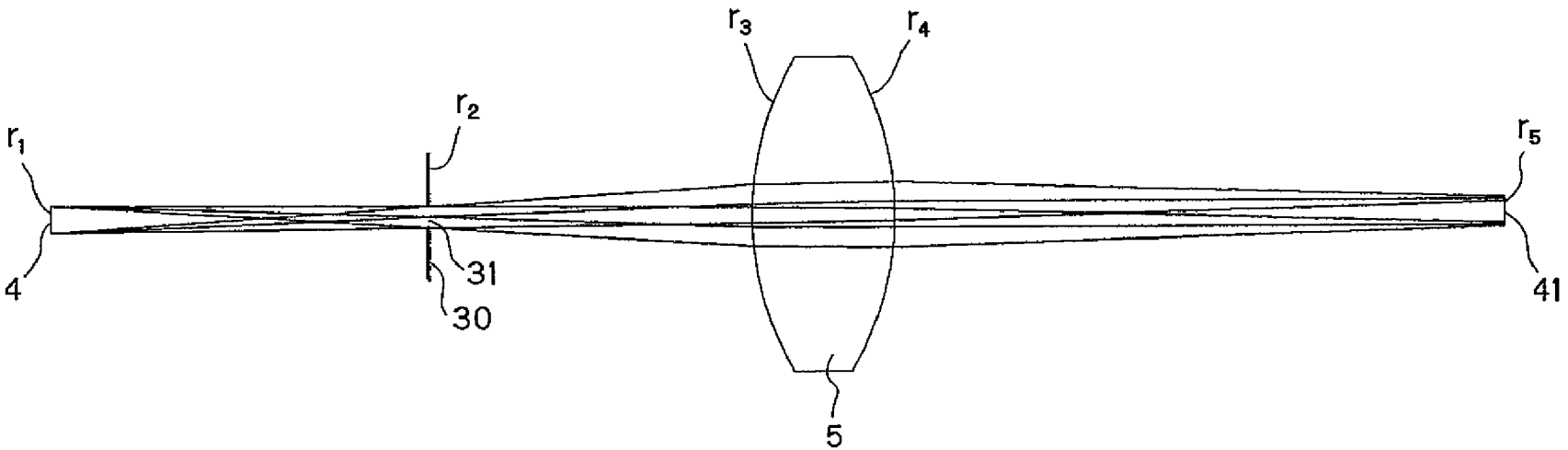
FIG. 31 is a sectional view, as taken along the subordinate scan direction, of the optical system corresponding to one microlens in Example 2.

FIGS. 30 and 31 are sectional views of the optical system corresponding to one microlens 5 in Example 2 as viewed in the main, and the subordinate scan direction, respectively. There is none of the glass substrate located on the exit side of the light emitter device 2, and the stop plate 30 is located in space between the light emitter block 4 and the microlens array 5.

There are the numerical data given below about this example, wherein the optical surface $r_1$ is the light emitter block (object plane) 4, the optical surface $r_2$ is the aperture 31 in the stop plate 30, the optical surfaces $r_3$ and $r_4$ are the object-side and image-side surfaces of the microlens 5, and the optical surface $r_5$ is the photosensitive member (image plane) 41.

Figure 32A:
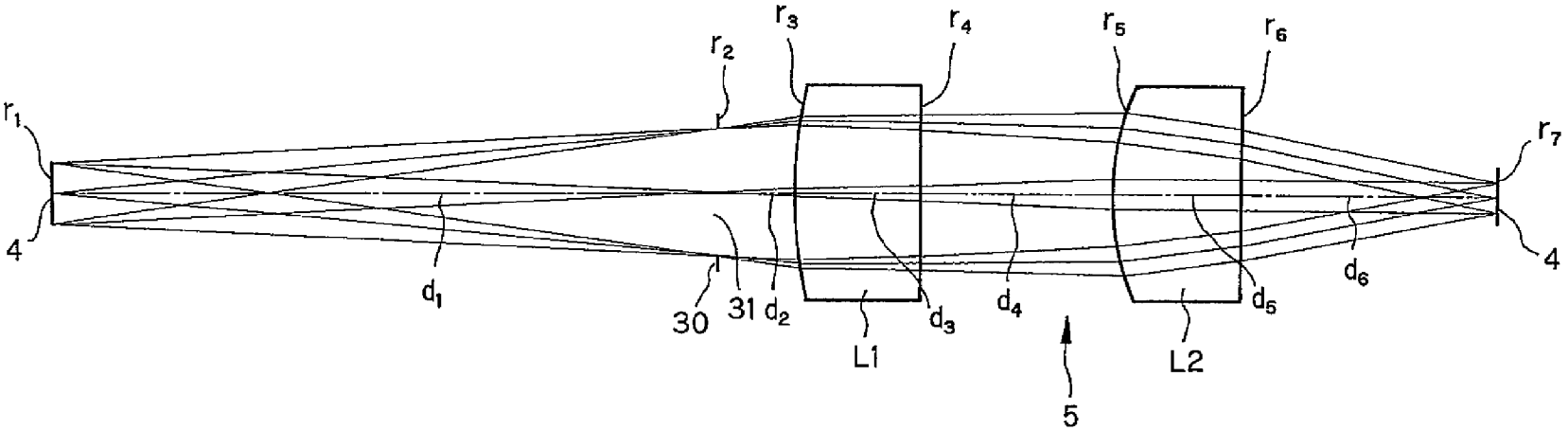
FIG. 32 is a sectional view, as taken along the main, and the subordinate scan direction, of the optical system corresponding to one microlens in Example 3.
Figure 32B:
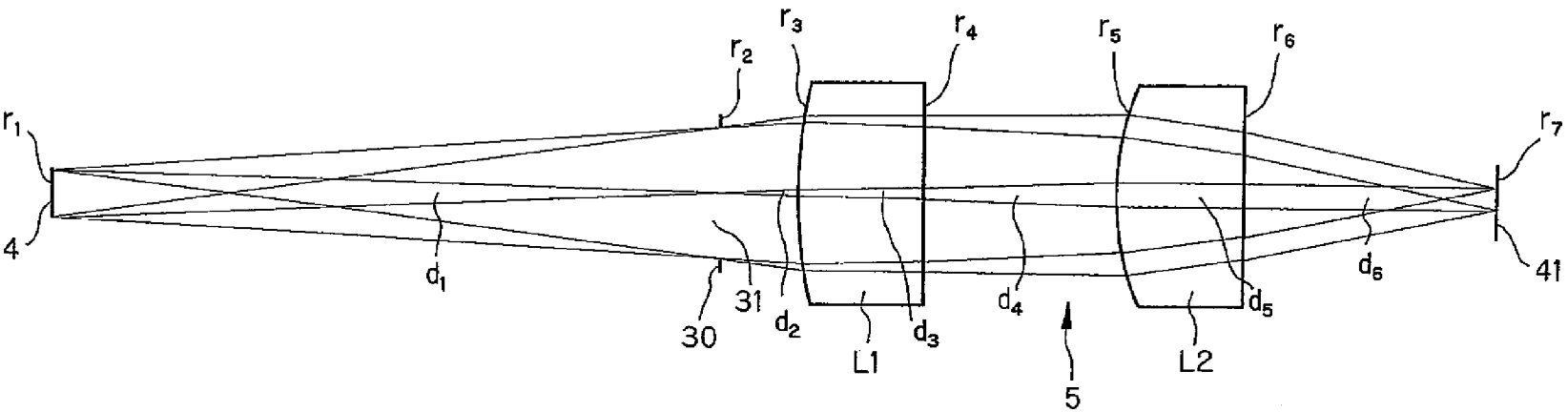

FIGS. 32(*a*) and 32(*b*) are sectional views of the optical system corresponding to one microlens 5 in Example 3 as viewed in the main, and the subordinate scan direction, respectively. There is none of the glass substrate located on the exit side of the light emitter device 2, the microlens 5 is made up of the plano-convex positive lens L1 and the plano-convex positive lens L2, and the stop plate 30 is located on the object-side focal plane of the microlens 5 in space between the light emitter block 4 and the microlens 5.

There are the numerical data given below about this example, wherein the optical surface $r_1$ is the light emitter block (object plane) 4, the optical surface $r_2$ is the aperture 31 in the stop plate 30, the optical surfaces $r_3$ and $r_4$ are the object-side and image-side surfaces of the plano-convex positive lens L1, the optical surfaces $r_5$ and $r_6$ are the object-side and image-side surfaces of the plano-convex positive lens L2, and the optical surface $r_7$ is the photosensitive member (image plane) 41.

Figure 33A:
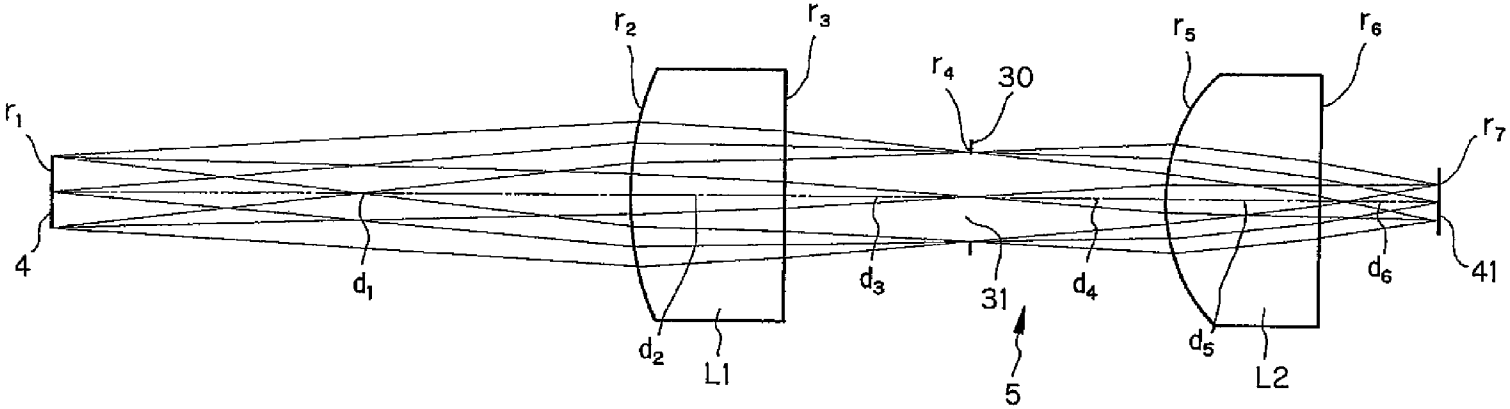
FIG. 33 is a sectional view, as taken along the main, and the subordinate scan direction, of the optical system corresponding to one microlens in Example 4.
Figure 33B:
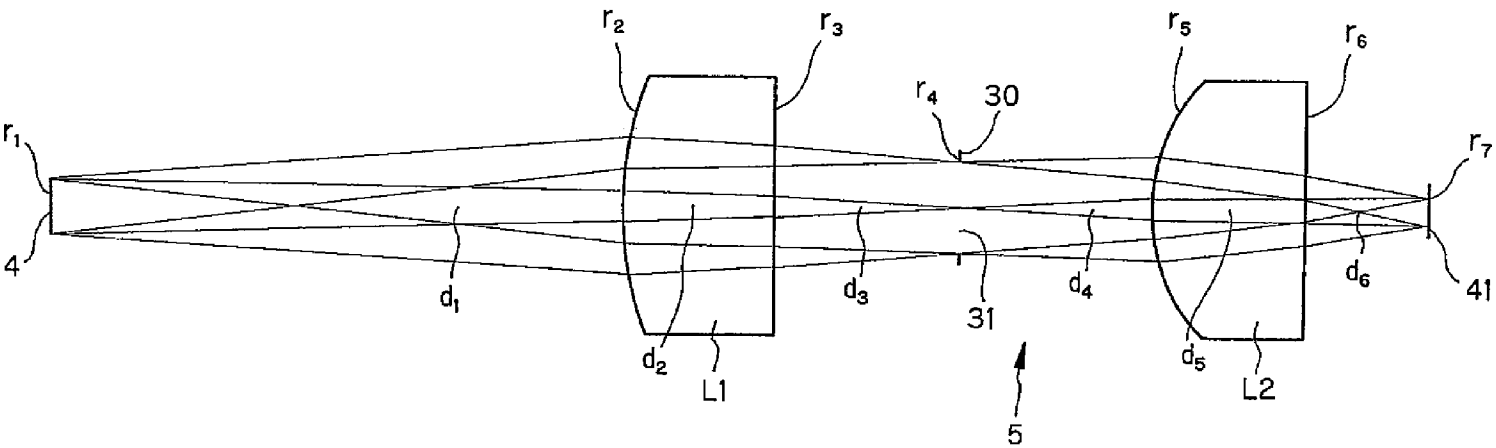

FIGS. 33(*a*) and 33(*b*) are sectional views of the optical system corresponding to one microlens 5 in Example 4 as viewed in the main, and the subordinate scan direction, respectively. There is none of the glass substrate located on the exit side of the light emitter device 2, the microlens 5 is made up of the plano-convex positive lens L1 and the plano-convex positive lens L2, and the stop plate 30 is located on the object-side focal plane of the plano-convex positive lens L2 in space between the plano-convex positive lenses L1 and L2.

There are the numerical data given below about this example, wherein the optical surface $r_1$ is the light emitter block (object plane) 4, the optical surfaces $r_2$ and $r_3$ are the object-side and image-side surfaces of the plano-convex positive lens L1, the optical surface $r_4$ is the aperture 31 in the stop plate 30, the optical surfaces $r_5$ and $r_6$ are the object-side and image-side surfaces of the plano-convex positive lens L2, and the optical surface $r_7$ is the photosensitive member (image plane) 41.

Figure 34A:
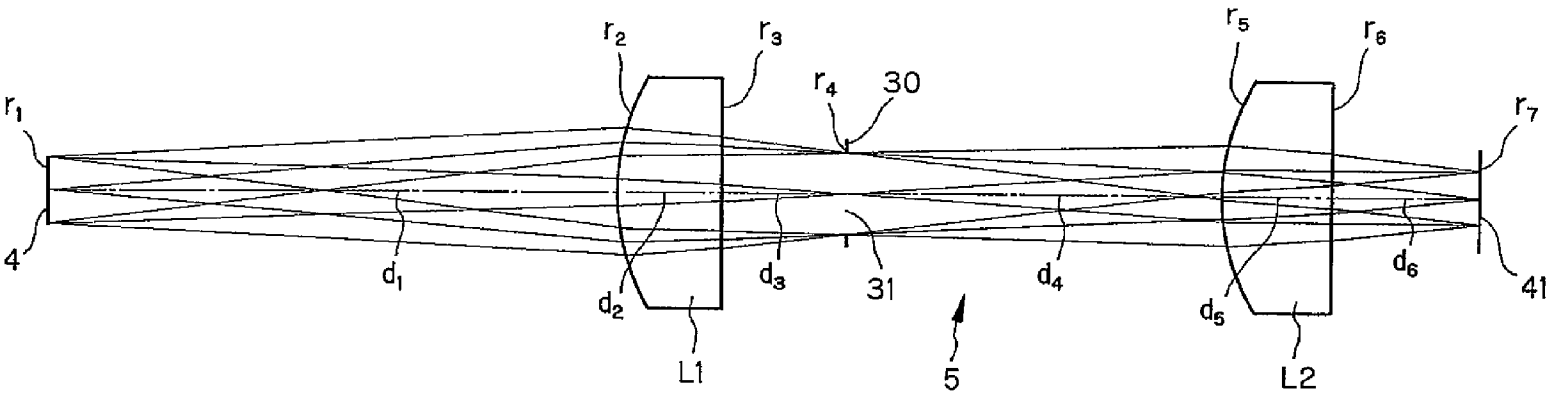
FIG. 34 is a sectional view, as taken along the main, and the subordinate scan direction, of the optical system corresponding to one microlens in Example 5.
Figure 34B:
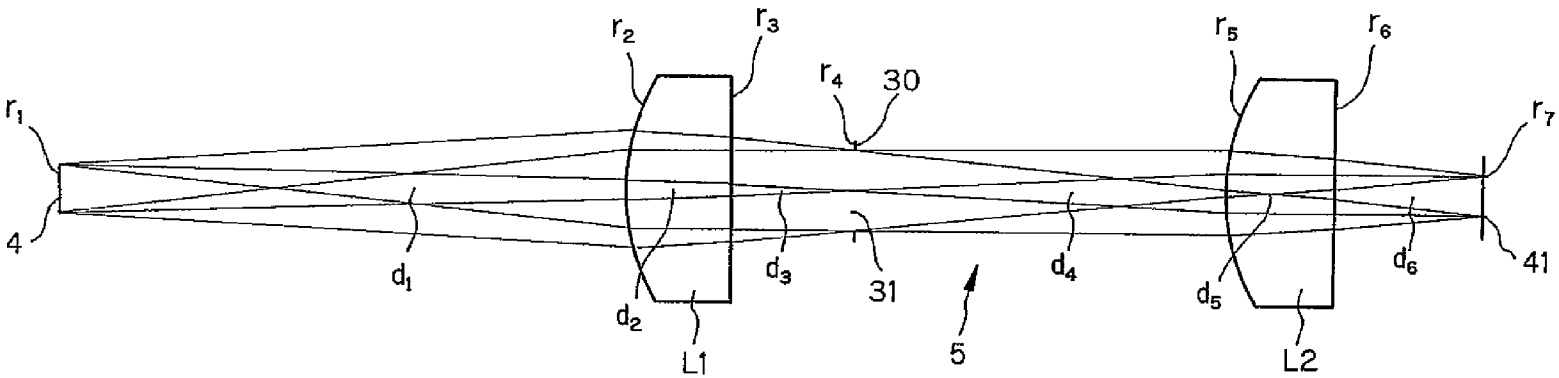

FIGS. 34(*a*) and 34(*b*) are sectional views of the optical system corresponding to one microlens 5 in Example 5 as viewed in the main, and the subordinate scan direction, respectively. There is none of the glass substrate located on the exit side of the light emitter device 2, the microlens 5 is made up of the plano-convex positive lens L1 and the plano-convex positive lens L2, and the stop plate 30 is located on the object-side focal plane of the plano-convex positive lens L2 in space between the plano-convex positive lenses L1 and L2. In this case, however, the plano-convex positive lenses L1 and L2 are of the same lens shape.

There are the numerical data given below about this example, wherein the optical surface $r_1$ is the light emitter block (object plane) 4, the optical surfaces $r_2$ and $r_3$ are the object-side and image-side surfaces of the plano-convex positive lens L1, the optical surface $r_4$ is the aperture 31 in the stop plate 30, the optical surfaces $r_5$ and $r_6$ are the object-side and image-side surfaces of the plano-convex positive lens L2, and the optical surface $r_7$ is the photosensitive member (image plane) 41.

Figure 35:
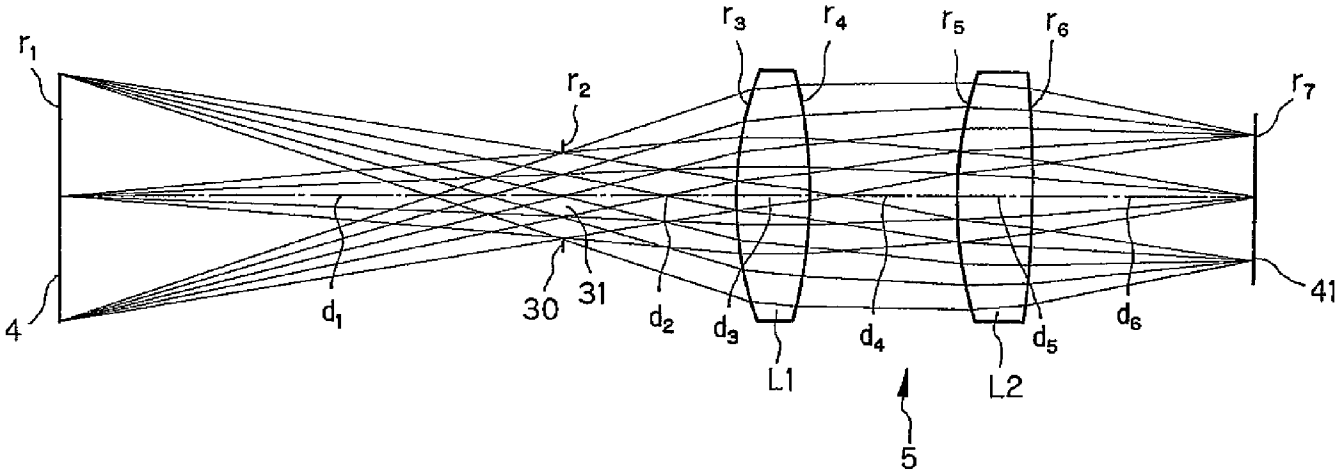
FIG. 35 is a sectional view, as taken along the main, and the subordinate scan direction, of the optical system corresponding to one microlens in Example 6.
Figure 35:
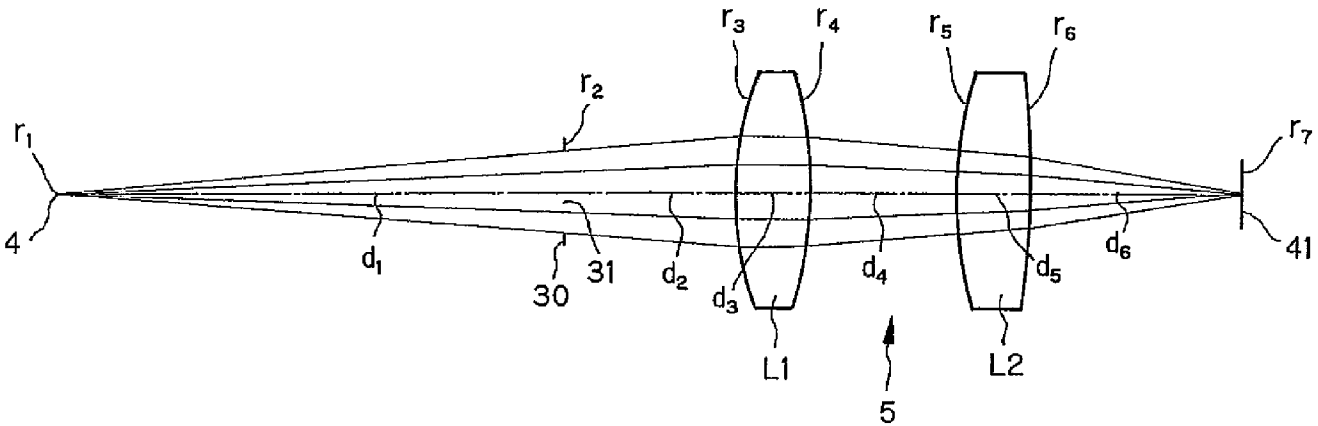

FIGS. 35(*a*) and 35(*b*) are sectional views of the optical system corresponding to one microlens 5 in Example 6 as viewed in the main, and the subordinate scan direction, respectively. There is none of the glass substrate located on the exit side of the light emitter device 2, the microlens 5 is made up of the double-convex positive lens L1 and the double-convex positive lens L2, and the stop plate 30 is located between the plano-convex positive lenses L1 and L2 and at a position that is shifted from the object-side focal plane of the microlens 5 by 10% of the focal length of the microlens 5 toward the side of the light emitter device 2.

There are the numerical data given below about this example, wherein the optical surface $r_1$ is the light emitter block (object plane) 4, the optical surface $r_2$ is the aperture 31 in the stop plate 30, the optical surfaces $r_3$ and $r_4$ are the object-side and image-side surfaces of the double-convex positive lens L1, the optical surfaces $r_5$ and $r_6$ are the object-side and image-side surfaces of the double-convex positive lens L2, and the optical surface $r_7$ is the photosensitive member (image plane) 41. An aspheric surface is used at the object-side surface of each double-convex positive lens L1, L2. Note here that with r indicative of a distance from the optical axis, the aspheric shape is given by $$cr^2/\{1+\sqrt{(1-c^2r^2)}\}+Ar^4+Br^6$$

where c is an axial curvature (1/r), and A and B are the $4^{th}$ and $6^{th}$-order aspheric coefficients, respectively. In the data numerated below, $A_3$ and $B_3$ are the $4^{th}$ and $6^{th}$-order aspheric coefficients of the object-side surface of the double-convex positive lens L1, and $A_5$ and $B_5$ are the $4^{th}$ and $6^{th}$-order aspheric coefficients of the object-side surface of the double-convex positive lens L2.

EXAMPLE 1

| | | | |
|---|---|---|---|
| $r_1 = \infty$ (Object plane) | $d_1 = 2$ | $n_{d1} = 1.5168$ | $\nu_{d1} = 64.2$ |
| $r_2 = \infty$ | $d_2 = 0$ | $n_{d2} = 1.5168$ | $\nu_{d2} = 64.2$ |
| $r_3 = \infty$ (Stop) | $d_3 = 1.15$ | | |
| $r_4 = 1.3$ | $d_4 = 0.5$ | | |
| $r_5 = -1.24$ | $d_5 = 2.3$ | | |
| $r_6 = \infty$ (Image plane) | | | |

Used wavelength$\lambda$ = 760 nm
Lens diamieterD = 1 mm
Optical magnification$\beta$ = −1

EXAMPLE 2

| | | | |
|---|---|---|---|
| $r_1 = \infty$ (Object plane) | $d_1 = 1.3$ | $n_{d1} = 1.5168$ | $\nu_{d1} = 64.2$ |
| $r_2 = \infty$ (Stop) | $d_2 = 1.12$ | | |
| $r_3 = 1.24$ | $d_3 = 0.5$ | | |
| $r_4 = -1.24$ | $d_4 = 2.3$ | | |
| $r_5 = \infty$ (Image plane) | | | |

Used wavelength$\lambda$ = 760 nm
Lens diameterD = 1 mm
Optical magnification$\beta$ = −1

EXAMPLE 3

| | | | |
|---|---|---|---|
| $r_1 = \infty$ (Object plane) | $d_1 = 5.1774$ | $n_{d1} = 1.5168$ | $\nu_{d1} = 64.2$ |
| $r_2 = \infty$ (stop) | $d_2 = 0.6036$ | $n_{d2} = 1.5168$ | $\nu_{d2} = 64.2$ |
| $r_3 = 2.60208$ | $d_3 = 1.0$ | | |
| $r_4 = \infty$ | $d_4 = 1.5$ | | |
| $r_5 = 1.51819$ | $d_5 = 1.0$ | | |

-continued

| | |
|---|---|
| $r_6 = \infty$ | $d_6 = 2.0$ |
| $r_7 = \infty$ (Image plane) | |

Used wavelength$\lambda$ = 632.5 nm
Lens diameterD = 1.4 mm
Optical magnification$\beta$ = −0.5

EXAMPLE 4

| | | | |
|---|---|---|---|
| $r_1 = \infty$ (Object plane) | $d_1 = 3.7868$ | $n_{d1} = 1.5168$ | $\nu_{d1} = 64.2$ |
| $r_2 = 1.5698$ | $d_2 = 1.0$ | $n_{d2} = 1.5168$ | $\nu_{d2} = 64.2$ |
| $r_3 = \infty$ | $d_3 = 1.2211$ | | |
| $r_4 = \infty$ (Stop) | $d_4 = 1.2789$ | | |
| $r_5 = 0.8852$ | $d_5 = 1.0$ | | |
| $r_6 = \infty$ | $d_6 = 0.8$ | | |
| $r_7 = \infty$ (Image plane) | | | |

Used wavelength$\lambda$ = 632.5 nm
Lens diameterD = 1.4 mm
Optical magnification$\beta$ = −0.5

EXAMPLE 5

| | | | |
|---|---|---|---|
| $r_1 = \infty$ (Object plane) | $d_1 = 3.7199$ | $n_{d1} = 1.5168$ | $\nu_{d1} = 64.2$ |
| $r_2 = 1.3000$ | $d_2 = 0.7000$ | $n_{d2} = 1.5168$ | $\nu_{d2} = 64.2$ |
| $r_3 = \infty$ | $d_3 = 0.7987$ | | |
| $r_4 = \infty$ (stop) | $d_4 = 2.4556$ | | |
| $r_5 = 1.3000$ | $d_5 = 0.7000$ | | |
| $r_6 = \infty$ | $d_6 = 1.0000$ | | |
| $r_7 = \infty$ (image plane) | | | |

Used wavelength$\lambda$ = 632.5 nm
Lens diameterD = 1.4 mm
Optical magnification$\beta$ = −0.85

EXAMPLE 6

| | | | |
|---|---|---|---|
| $r_1 = \infty$ (Object plane) | $d_1 = 3.4186$ | $n_{d1} = 1.5168$ | $\nu_{d1} = 64.2$ |
| $r_2 = \infty$ (Stop) | $d_2 = 1.1814$ | $n_{d2} = 1.5168$ | $\nu_{d2} = 64.2$ |
| $r_3 = 2.0156$ (Aspheric Surface) | $d_3 = 0.5000$ | | |
| $A_3 = -0.011342$ | $d_4 = 1.0000$ | | |
| $B_3 = -0.059580$ | $d_5 = 0.5000$ | | |
| $r_4 = -3.0000$ | $d_6 = 1.5000$ | | |
| $r_5 = 2.3505$ (Aspheric surface) | | | |
| $A_5 = -0.10582$ | | | |
| $B_5 = 0.090005$ | | | |
| $r_6 = -6.0000$ | | | |
| $r_7 = \infty$ (Image plane) | | | |

Used wavelength$\lambda$ = 632.5 nm
Lens diameterD = 1.6 mm
Optical magnification$\beta$ = −0.54
Width of the group of pixels on the image plane (overall width) = 0.87 mm
Angle of chief rays with the optical axis on the light source side at the maximum angle of view = 13.171°
Angle of chief rays with the optical axis on the image plane side at the maximum angle of view = −1.363°

As can be seen from Example 6, when the stop plate 30 is located off the object-side focal plane of the microlens 5 by ±10% from the focal length of the micro-lens 5, it does a bit damage to the telecentric capability on the image side. Yet, in the case of Example 6, the angle with the image plane 41 of the center ray of a light beam imaged at the end pixel 8*x*(FIG.

12) of the imaging spots formed at the image plane 41 (the group of pixels) is about 1.4 degrees, a figure that does not become practically any problem, because of a barely 2.4 μm shifting of the entrance position even with respect to a 100 μm defocus.

From this example, it can be appreciated that even when the stop plate 30 is off the lens system portion on the imaging side of the microlens 5 with respect to the stop plate 30 by ±10% of the focal length of that lens system portion, the object of the invention is well achievable.

While the line head of the invention and the imaging apparatus using the same have been described with the principles and examples, it is to be understood that the invention is never limited thereto, and so many modifications may be possible.

What we claim is:

1. A line head, comprising:

a light emitter array comprised of a plurality of light emitter blocks located apart in a main scan direction, each of the light emitter blocks having at least one row of light emitter devices arranged in the main scan direction;

a lens array having a plurality of positive lens systems, the positive lens systems corresponding to a light emitter block; and a stop plate having a plurality of aperture stops, the stop plate being located between the light emitter array and the lens array, wherein an aperture stop is located near a light-gathering position of the positive lens system when parallel light is entered from a write plane side, the light emitter array has the light emitter blocks on a first surface of a transparent substrate, the lens array is located on a second surface that is on a side opposite to the first surface of the transparent substrate, and the stop plate is in contact with the second surface of the transparent substrate.

2. The line head according to claim 1, wherein the positive lens system comprises a single positive lens.

3. The line head according to claim 1, wherein the positive lens system comprises two positive lenses.

4. The line head according to claim 3, wherein the aperture stop is located off the light-gathering position by ±10% of a focal length of the positive lens near the aperture stop in the positive lens system.

5. The line head according to claim 3, wherein the aperture stop is located near a front focal position of a positive lens on an image side.

6. The line head according to claim 1, wherein the aperture stop is configured to minimize an aperture diameter in the main scan direction.

7. The line head according to claim 1, wherein the light emitter block includes more than two rows of light emitter devices located in a subordinate scan direction.

8. The line head according to claim 1, wherein the plurality of light emitter blocks are located in a subordinate scan direction.

9. The line head according to claim 1, wherein the light emitter device is an organic EL device.

10. The line head according to claim 1, wherein the light emitter device is an LED.

* * * * *